US005519195A

United States Patent [19]

Keefer et al.

[11] Patent Number: 5,519,195

[45] Date of Patent: May 21, 1996

[54] METHODS AND DEVICES USED IN THE MICROWAVE HEATING OF FOODS AND OTHER MATERIALS

[75] Inventors: Richard M. Keefer, Peterborough; Cindy M. Lacroix, Kingston, both of Canada

[73] Assignee: Beckett Technologies Corp., Mississauga, Canada

[21] Appl. No.: 15,311

[22] Filed: Feb. 9, 1993

Related U.S. Application Data

[63] Continuation of Ser. No. 607,861, Nov. 1, 1990, abandoned, which is a continuation-in-part of Ser. No. 321,758, Mar. 10, 1989, abandoned.

[30] Foreign Application Priority Data

Feb. 9, 1989 [CA] Canada ..... 590564
Jan. 22, 1990 [ZA] South Africa ..... 90/0446

[51] Int. Cl.[6] ..... H05B 6/80

[52] U.S. Cl. ..... 219/728; 219/725; 219/730; 99/DIG. 14; 426/107; 426/113; 426/234; 426/243

[58] Field of Search ..... 219/727, 728, 219/730, 745, 736, 734, 725, 759; 426/107, 113, 234, 243; 99/DIG. 14

[56] References Cited

U.S. PATENT DOCUMENTS

| | | | |
|---|---|---|---|
| 3,230,864 | 1/1966 | Krajewski | 219/10.55 E |
| 3,845,266 | 10/1974 | Derby | 219/728 |
| 3,940,188 | 3/1976 | Derby | 219/10.55 E |
| 4,228,945 | 10/1980 | Wysocki | 426/113 |
| 4,230,924 | 10/1980 | Brastad et al. | 219/10.55 E |
| 4,656,325 | 4/1987 | Keefer | 219/10.55 E |
| 4,814,568 | 3/1989 | Keefer | 219/10.55 E |
| 4,866,234 | 9/1989 | Keefer | 219/10.55 E |
| 4,883,936 | 11/1989 | Maynard et al. | 219/10.55 F |
| 4,888,459 | 12/1989 | Keefer | 219/10.55 E |
| 4,904,836 | 2/1990 | Turpin et al. | 219/10.55 E |
| 4,962,293 | 10/1990 | Lackey | 219/10.55 E |
| 5,006,684 | 4/1991 | Wendt et al. | 219/10.55 E |
| 5,038,009 | 8/1991 | Babbitt | 219/10.55 E |
| 5,117,078 | 5/1992 | Beckett | 219/728 |

OTHER PUBLICATIONS

Fuller, A. J. Baden, "Microwaves An Introduction to Microwave Theory and Techniques", published by Pergamon Press 1979, pp. 52–57 and 75–80.

Pehl, Erich, "Microwave Technology", published by Artech House, Inc. 1985, pp. 39–44.

*Primary Examiner*—Tu Hoang
*Attorney, Agent, or Firm*—Sim & McBurney

[57] ABSTRACT

A method and device for enhancing the heating of a surface layer of an article being heated by microwave energy is characterized by directing the energy through the surface layer into a main portion of the article in such a manner that the modes of the energy are in cut-off in the surface layer.

30 Claims, 12 Drawing Sheets

FIG. 44A
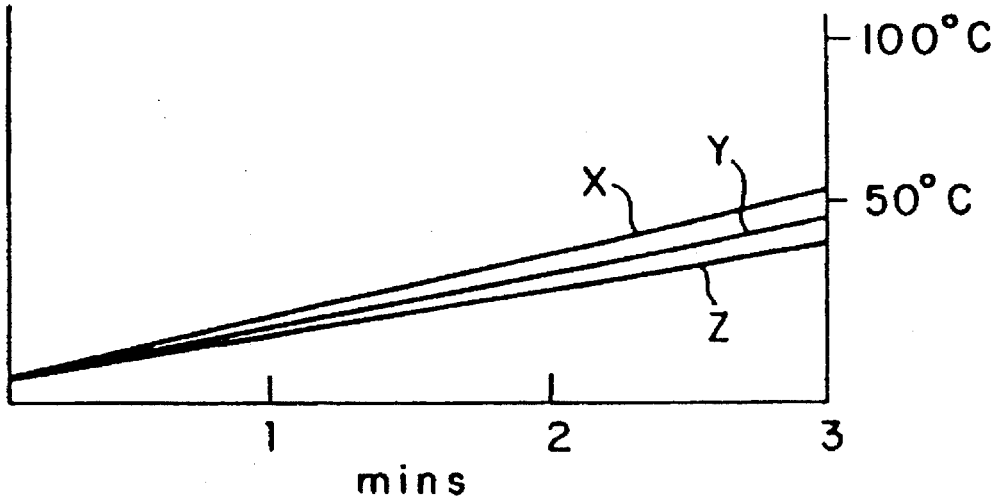
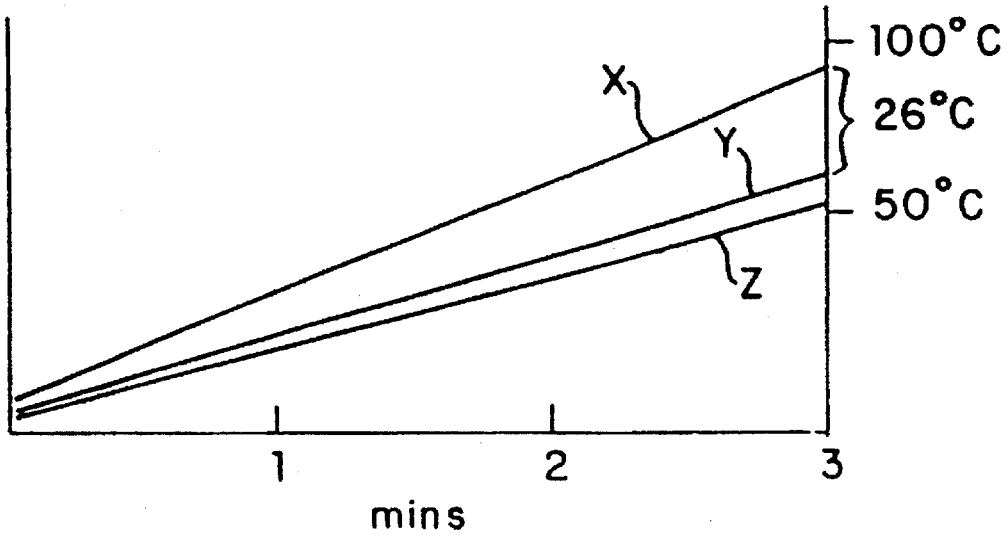
FIG. 44B

METHODS AND DEVICES USED IN THE MICROWAVE HEATING OF FOODS AND OTHER MATERIALS

This application is a continuation of Ser. No. 607,861, filed Nov. 1, 1990 now abandoned, which is a continuation-in-part of Ser. No. 321,758, filed Mar. 10, 1989 now abandoned.

BACKGROUND OF THE INVENTION

This invention relates to methods and devices for modifying microwave energy fields, having utility in the microwave heating of bodies of material exemplified by (but not limited to) foodstuffs.

It is well known that the conventional microwave cooking or heating of a food load does not provide effective browning or crispening of the food surfaces. Those food products that have a surface composed of a material different from that of the main portion of the food article, such as a crust or a layer of batter or breading, for example a pie or a breaded fish fillet, require this separate surface layer to reach a higher temperature than the bulk of the food, in order that such surface layer be browned or crispened. For this reason, a conventional convection oven set at a relatively high temperature has been the traditional method of cooking such food products.

There are also other types of food articles in which the nature of the surface layer is essentially the same as that of the main portion of the article, but it nevertheless requires to be browned and/or crispened. Examples in this category are the undersurface of a pizza, the two surfaces of a pancake, hash brown potatoes or french fried potatoes.

PRIOR ART

The conventional method of trying to meet this need in microwave cooking has been by means of devices known as susceptors. A susceptor is a device that incorporates lossy material, i.e. material that absorbs the microwave energy to become heated. This device is then placed close to the surface layer to be browned or crispened so that the heat in the susceptor is transferred by conduction and radiation to this surface layer. This process necessarily requires the temperature of the susceptor to be higher than that of the surface layer in order for the heat to flow into such layer. It has been found that there are practical disadvantages in heating the susceptor to the necessary high temperatures. There is always the risk of overheating and of breakdown of the material of the susceptor, and even the generation of toxic products.

An example of one method of attempting to achieve this type of surface heating effect has been suggested by W. A. Brastad et al in U.S. Pat. No. 4,230,924 issued Oct. 28, 1980. This proposal involves wrapping the food product in a flexible sheet of dielectric material that functions as a substrate to carry a thin metallic coating that is subdivided into a number of individual metal islands separated by non-metallic gaps formed by exposed strips of the dielectric material of the substrate. When a food load wrapped in such a flexible sheet is exposed to microwave energy in a microwave oven, some of the energy passes through the sheet to heat the food load dielectrically in the usual manner, while some of the energy is converted in the metallic islands into thermal energy, i.e. the islands act as susceptors, so that, provided the islands are closely adjacent to a surface of the food load, the heat generated in the islands will be transferred directly by conduction to the food surface to elevate its temperature and thus achieve a browning or crispening effect. The mentioned patent discloses that the microwave-transparency of the wrapping can be varied in order to adapt to the requirements of a particular food article by modifying the ratio between the dielectric (bulk) heating and the thermal heating generated in the wrapping and transferred therefrom to the food surface.

In other words, the wrapping described in this prior patent simultaneously acts as a microwave-transparent covering for part of the energy, and as a susceptor, i.e. a structure that absorbs microwave energy and hence becomes heated, for the remainder of the applied energy.

Another known type of susceptor is that embedded in a cooking utensil, such as a frying pan or baking dish. The utensil can be placed in a microwave oven, initially with or without food in it. The susceptor in the utensil absorbs microwave energy, so that the cooking surface of the utensil becomes heated to a high temperature. When the food is added, or if it has been present from the outset, its bulk is heated dielectrically in the usual manner in a microwave oven and its surface is browned or crispened by the cooking surface of the utensil.

SUMMARY OF THE INVENTION

In contrast to the concept of using a susceptor to heat a surface layer of a food article, either directly by a wrapping, or indirectly through a preheated dish, the present invention provides an arrangement in which the surface layer of the article to be heated as well as its main portion beneath the surface layer continue to be heated dielectrically, i.e. by the microwave energy, without first converting such energy into heat in a susceptor. According to the invention, the microwave energy field is so altered that the dielectric heating effect within the surface layer is enhanced relative to the dielectric heating effect in the main portion of the article. As a result, the surface layer reaches a higher temperature. In the case of a food article, this non-uniformity of heating results in browning and/or crispening of the surface layer.

The surface layer of the food article may be a top layer (for example, a pie crust), or a bottom layer (for example, a pizza base), or both top and bottom layers (for example, a breaded fish fillet).

According to the invention the desired enhanced heating effect within the surface layer is achieved by means of a so-called mode-filtering structure that causes the microwave energy to enter the absorber (foodstuff or other body to be heated) in the form of cut-off propagation (herein sometimes also referred to as "evanescent propagation"), thus causing the heating effect to be concentrated at the absorber surface adjacent the mode-filtering structure.

The term "mode-filtering" is employed to refer to accentuation of the transmission of higher order modes while reflecting fundamental modes.

Microwaves that are in cut-off are referred to as propagating evanescently because they decay exponentially. Due to this strong decay of evanescent microwaves, the ratio of surface to bulk field intensities (or heating) is increased. Analogously with the skin effect observed at high frequencies in conductors, more energy is deposited on the surface layer than in the bulk from the modes of microwave energy that propagate through the apertures in cut-off in the surface layer.

The device employed for this purpose, in accordance with the invention, consists of a sheet of microwave transparent material provided with substantially non-absorptive conductive material defining either an island-aperture array or an array of annuli defining apertures, the dimensions of the annuli or of the gaps between the islands and the apertures being such as to achieve the desired absorption profile.

The apertures will be of such dimensions that, at the frequency of the microwave energy and with the sheet located adjacent the surface layer of the article to be heated, the modes of energy that propagate through the apertures will be in cut-off in the surface layer.

Such modes may or may not be in cut-off in the main portion (bulk) of the article lying beneath the surface layer.

A device according to the invention can be located on a separate sheet of microwave-transparent material, or it can be embodied in a container for the article, e.g. as a bottom wall or lid of such container. In the latter case, small holes for venting steam and/or for draining liquids such as fat can be provided in the container structure. The present arrangement readily lends itself to the provision of such venting and draining holes, whereas it would be difficult to incorporate this feature into a standard susceptor or the devices described by the aforemented U.S. patent.

The term "container" as used herein embraces all manner of elements or devices (including, but not limited to, flat sheets, laminar members, pouches, pans, lidded containers, etc.) that at least partially enclose, contain, hold, support, or are supported by, the foodstuff or other material during heating in a microwave oven.

The invention also relates to a method of enhancing the heating of a surface layer of an article being heated by microwave energy by utilizing the foregoing concept of arranging the energy to be in cut-off in at least the surface layer.

In those instances where the surface layer is formed of the same substance as the main portion of the article, the modes of microwave energy that propagate through the apertures will be in cut off for both the surface layer and the main portion. As a result, attenuation will be higher per unit distance into the article, but there will still be a greater heating effect in the surface layer due to evanescent propagation. The fact that the propagation into the main portion is also evanescent will result in less depth of heating in such main portion, but this feature may well be acceptable in practice if the product is a thin one, e.g. pizza, pancake, sliced potato etc.

It is known that the generation or enhancement of modes of the microwave energy of higher order than the fundamental modes propagating in the article to be heated can enhance the uniformity of heating of the article in its lateral dimension. See for example U.S. Pat. No. 4,866,234 of R. M. Keefer issued Sep. 12, 1989 (European patent application 86304880 filed Jun. 24, 1986 and published Dec. 30, 1986 under No. 206,811). See also European applications of R. M. Keefer published Nov. 19, 1987 under No. 246041; published May 24, 1989 under No. 317203 and published Jun. 22, 1988 under No. 271981.

It should be explained that the term "mode" is used in this specification and claims in its art-recognized sense, as meaning one of several states of electromagnetic wave oscillation that may be sustained in a given resonant system at a fixed frequency, each such state or type of vibration (i.e. each mode) being characterised by its own particular electric and magnetic field configurations or patterns. The fundamental modes, i.e. normally the 1-0 mode and the 0-1 mode in a rectangular system, of a body of material to be heated, or of such body and a container in which it is located, are characterised by an electric field pattern (power distribution) typically concentrated around the edge (as viewed in a horizontal plane) of the body of the substance to be heated, or around the periphery of its container when the substance is enclosed by and fills a container, these fundamental modes predominating in a system that does not include any higher order mode generating means. The fundamental modes are thus defined by the geometry of the container and the contained body of material to be heated, or alternatively by such body itself when it constitutes a separate article that is not placed in a container.

A mode of a higher order than that of the fundamental modes is a mode for which the electric field pattern (again, for convenience of description, considered as viewed in a horizontal plane) corresponds to each of a repeating series of areas smaller than that circumscribed by the electric field pattern of the fundamental modes. Each such electric field pattern may be visualized, with some simplification but nevertheless usefully, as corresponding to a closed loop in the horizontal plane.

The preferred embodiments of the present invention combine the uniformity of heating of the load in the lateral dimensions that can be achieved with the generation of higher order modes, with the desired disuniformity of heating in the direction perpendicular to the lateral dimensions of the load, i.e. in the direction perpendicular to the surface of the load, as is required for the surface to be browned or crispened.

BRIEF DESCRIPTION OF THE DRAWINGS

In the accompanying drawings:

FIG. 44A and 44B are graphs showing the results of this experiment; and

DETAILED DESCRIPTION OF THE PREFERRED EMBODIMENTS

Figure 1:
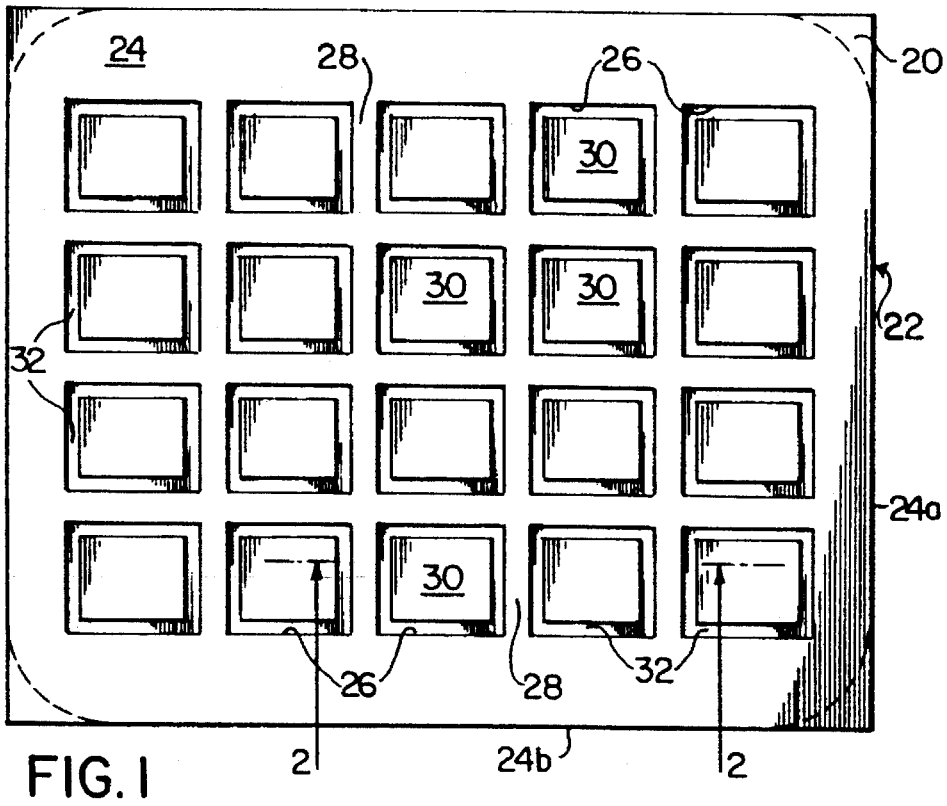
FIG. 1 is a top plan view of an example of a mode-filtering structure embodying the present invention in a particular form.
Figure 2:
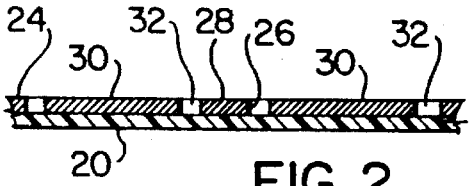
FIG. 2 is a fragmentary sectional view taken along the line 2—2 of FIG. 1.

The embodiment of the invention illustrated in FIGS. 1 and 2 is a mode-filtering structure including a flat sheet 20 (shown as rectangular) of microwave-transparent material such as a suitable plastic, which may, in one illustrative example, be the flat top portion of a microwave heating container lid. In this embodiment, a single mode filter 22 is mounted on a flat surface of the sheet 20. Specifically, an electrically conductive plate 24 (e.g., a plate of household-gauge aluminum foil, or of so-called converter gauge foil, the thickness of which would typically range between 6 and 7 microns) is bonded to the sheet top surface, the outer dimensions of this plate being about equal to the latter surface so that the plate 24 extends substantially over the entire sheet in a horizontal plane. This plate is formed with a plurality of apertures 26 each with a closed periphery of generally rectangular configuration; a 5×4 array of twenty apertures is shown, with all of the apertures being identical in size and spaced apart from each other and from the outer periphery of the plate by strip or mullion portions 28 of the plate. The apertures are equidistantly spaced in an arrangement that is symmetrical with respect to the plate 24 and sheet 20.

The mode filter 22 also includes a plurality of electrically conductive islands 30, which in this particular embodiment are identical to each other in shape and dimensions and are again conveniently fabricated of household-gauge aluminum foil, bonded to the same sheet surface as the plate 24. These islands 30 are equal in number to the apertures 26, and have closed generally rectangular peripheries substantially conforming in shape to the aperture peripheries but are smaller in area than the apertures; the islands 30 are respectively disposed within (and in register with) the apertures 26, so that the periphery of each island 30 is substantially uniformly spaced from the surrounding aperture periphery, and defines therewith a rectangular annular gap 32 (which, in this embodiment, is of substantially uniform width) closed or spanned by the microwave-transmissive dielectric material of the sheet 20. Thus a 5×4 array of twenty spaced, uniformly and symmetrically distributed rectangular annular gaps 32 is provided in the mode-filtering structure. It will be seen that these gaps constitute essentially the only microwave-transmissive areas or windows in the entire structure, since the sheet 20 is otherwise covered by the conductive plate 22.

In a specific dimensional example of the embodiment of FIGS. 1 and 2, each of the apertures 26 is a 2.20×1.8 cm rectangle, the strips 28 between apertures (on both the long and short sides of the apertures) being 0.5 cm in width. Each of the conductive islands 30 is a 1.70×1.3 cm rectangle, and is centered in its associated aperture so as to define therewith a rectangular annular gap 32 having a uniform width of 0.25 cm on all sides. The outer end columns of four apertures are spaced 1.0 cm from the short side edges 24*a* of the plate 24, and the outer side rows of five apertures are spaced 1.5 cm from the long side edges 24*b* of the plate 24, which has 2.0 cm-radiused corners.

A single mode filter as exemplified by the above-described embodiment of FIGS. 1–2 may be used (by way of non-limiting example) with metallic, composite, or microwave-transparent containers, including those described in one or more of the aforementioned copending applications. In some instances, the use of metallic containers is preferred, because radiation entering the container is then forced to interact with the mode filter. By contrast, when a mode filter is used with a microwave-transparent container, it exerts little influence on radiation entering the container through the other surfaces not adjacent to it.

Figure 23:
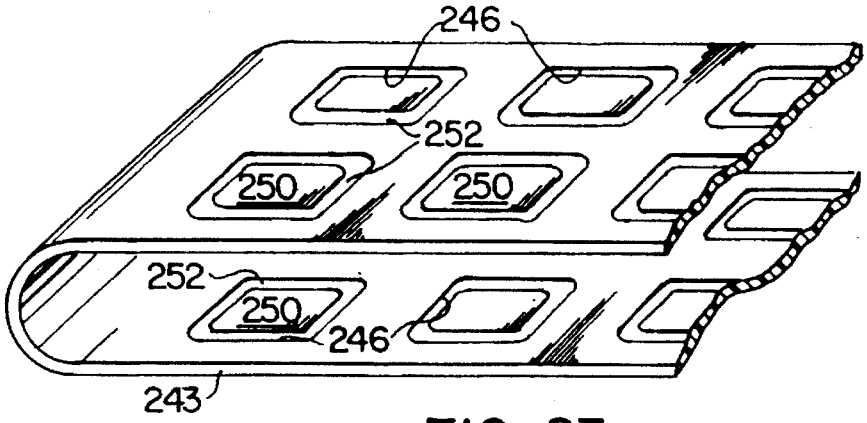
FIG. 23 is a fragmentary perspective view of yet another container embodying the invention.

To constitute a mode filter as in the above-described embodiment of the invention, an array of one or more metallic islands ("island array") is superimposed on an array of one or more corresponding apertures ("aperture array") of a metallic area or plate. Both the island and aperture arrays may be constructed (as by die-cutting) from aluminum foil, for example. When used with a metallic container, the mode filter is preferably positioned over the container, in electrical isolation from it, as in the embodiment of FIGS. 5–6 described below. However, the mode filter may also be in close mechanical and electrical contact with the container, or may be integral with it (as in a pouch type of construction, also described below, with reference to FIG. 23). When the aperture array is fabricated from rigid foil, a container or pan for holding the food to be heated may be constructed from the same foil, using similar techniques to those employed in the manufacture of "wrinkle-wall" or "smoothwall" pans.

Dielectric material is used to maintain the spatial relationship between the island and aperture arrays. Suitable dielectric material (typified by such plastics as polypropylene, polyester, or polycarbonate resins) shows good resistance to dielectric breakdown, has low dielectric losses, and maintains its strength properties at the service temperatures imposed by the heating of the food.

Each island is generally centered on each aperture, but may be either coplanar with the aperture, or (as hereinafter further explained, for example with reference to FIGS. 3–4 and 8–10) displaced vertically, so as to be approximately plane-parallel with the aperture. When the island array is coplanar with the aperture array, the area of each island is constrained to be less than that of the corresponding aperture. However, when the island and aperture arrays are vertically displaced (as, for example, in FIGS. 3–4), the islands may be of greater or lesser area than the corresponding apertures.

Figure 5:
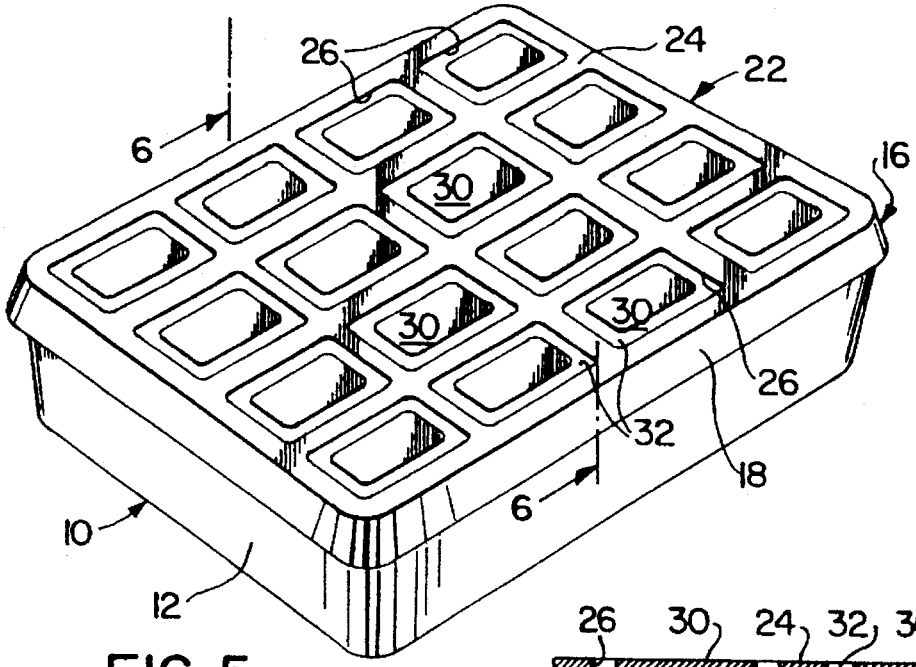
FIG. 5 is a perspective view of a microwave heating container, for holding a body of foodstuff, incorporating an embodiment of mode-filtering structure of the invention generally similar to that of FIG. 1.
Figure 6:
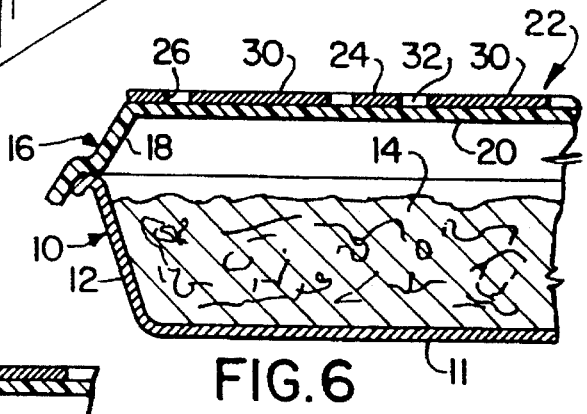
FIG. 6 is a fragmentary elevational sectional view of the same container, taken along the line 6—6 of FIG. 5.

One example of an arrangement for use of the mode-filtering structure of FIGS. 1 and 2 in conjunction with a microwave heating container is illustrated in FIGS. 5 and 6, which show a microwave heating container having a generally rectangular, upwardly opening tray 10, with a bottom 11 and side walls 12, fabricated of metal (e.g. stiff, formed aluminum foil), for receiving and holding a body of foodstuff 14 to be heated. A molded plastic (dielectric material) lid 16, transparent to microwave energy and having a downwardly extending portion 18 and a flat top or sheet portion 20, covers the upward opening of the tray, the downwardly extending portion seating on the tray rim. Typically, the upper surface of the contained foodstuff is spaced below the top of the lid.

The mode filter 22, as described with reference to FIGS. 1 and 2 (but here shown as having a 4×4 array of apertures and islands) is mounted on the upwardly facing flat surface of the lid top 20. Thus, the electrically conductive plate 24 (e.g., of household-gauge aluminum foil) is bonded to the lid top surface, extending substantially over the entire lid in a horizontal plane, though the plate is electrically isolated from the metallic tray 10 by the downwardly extending portion 18 of the dielectric material lid. The islands 30 are likewise bonded to the lid top surface. The arrangement of apertures and islands is symmetrical with respect to the rectangular lid top and thus with respect to the container as viewed in a horizontal plane. Thus a 4×4 array of sixteen spaced, uniformly and symmetrically distributed rectangular annular gaps 32 is provided in the lid top, constituting essentially the only microwave-transmissive areas or windows in the entire lid top, which is otherwise covered by the conductive plate 22.

Figure 7:
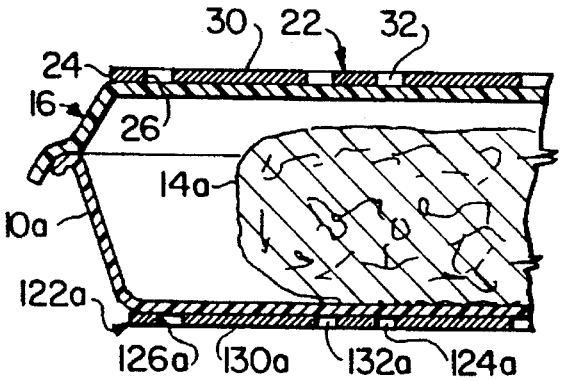
FIG. 7 is a view similar to FIG. 6 of a modified container incorporating two of the mode-filtering structures of the invention.

FIG. 7 illustrates a modified form of container in which the tray 10*a*, like the lid, is formed of microwave-transparent material rather than metal, and in which a second mode-filtering structure 122*a* (which may be identical to, and in register with, the above-described mode filter 22) is mounted on the downwardly-facing flat bottom surface of the microwave-transparent tray 10*a*. Both the plate 124*a* and islands 130*a* of the structure 122*a* may be constituted of household-gauge aluminum foil bonded to the tray bottom surface. The plate 124*a* defines an array of apertures 126*a*, the peripheries of which in cooperation with the peripheries of the islands 130*a* define an array of gaps 132*a* equal in size and number to, and respectively in register with, the gaps 32 of the upper mode filter 22.

Also, in FIG. 7, the contained body of foodstuff 14*a* is self-sustaining in shape and smaller than the internal dimensions of the tray, so that it is spaced inwardly away from the side walls of the tray. Since the container tray is microwave-transparent, the body 14*a* acts as a dielectric resonator, in determining the fundamental modes of the system. Stated more precisely, in the system of FIG. 7 the overall resonant boundaries are determined both by the body of foodstuff and by the mode-filtering structures, but power absorption is confined to the food cross-section. If the body 14*a* filled the container out to the side walls of the tray, so that the tray side walls defined the geometry of the body, still the effect of the microwave-transparent tray side walls in determining the resonant boundaries would be simply the consequence of the effect of the tray side walls in defining the food body geometry, in contrast to the situation that obtains when the tray is electrically conductive (microwave-reflective) and constitutes a cavity resonator.

Referring now to FIGS. 3, 4 and 8–10, vertical displacement of the island and aperture arrays may be obtained by locating each array at opposite faces of a dielectric sheet or, alternatively, by locating the islands on dielectric protrusions (which may be filled or unfilled). Dielectric protrusions may be obtained in the thermoforming of plastic film, for example.

Figure 3:
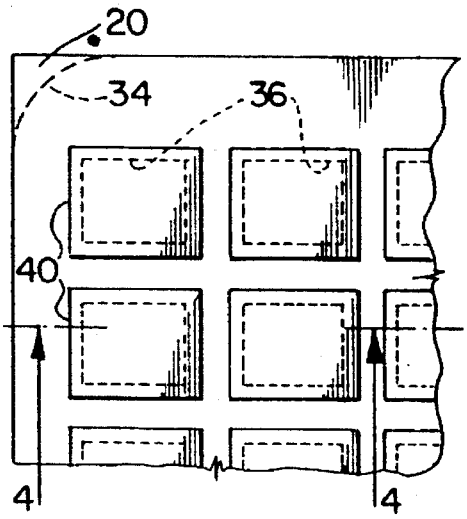
FIG. 3 is a fragmentary top plan view, similar to FIG. 1, of another embodiment of mode-filtering structure of the invention.
Figure 4:
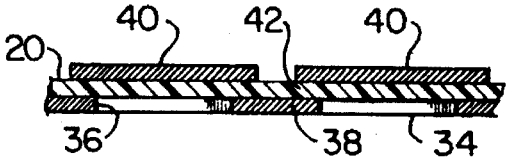
FIG. 4 is a fragmentary sectional view taken along the line 4—4 of FIG. 3.

FIGS. 3 and 4 show a rectangular flat plastic microwave-transparent sheet 20 of the type described above with reference to FIGS. 1 and 2 (e.g. the flat top of a microwave heating container lid 16 as shown in FIG. 5), but bearing a mode filter constituted of a conductive plate 34 (defining a 5×4 array of twenty rectangular apertures 36 separated by strips 38) mounted on the downwardly facing horizontal planar major surface of the sheet 20, and a 5×4 array of twenty rectangular conductive islands 40 mounted on the opposite (i.e. upwardly facing) horizontal planar major surface of the sheet 20 in register, respectively, with the apertures 36. In this mode filter, the apertures 36 and islands 40 are spaced apart vertically by the thickness of the sheet 20, and the rectangular annular gap 42 defined between each island 40 and the periphery of its associated aperture 36 is provided by virtue of the vertical spacing, since (as shown) the islands 40 are larger than the apertures 36, though conforming thereto in peripheral configuration.

Figure 8:
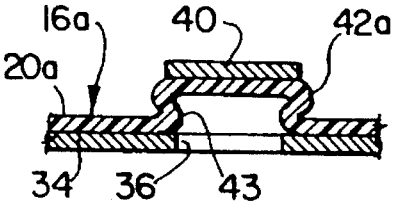
FIGS. 8, 9 and 10 are fragmentary elevational sectional views of the container lids and mode filters of three additional embodiments of the invention.

Alternatively, as FIG. 8 illustrates, the top 20*a* of a plastic lid 16*a* (otherwise similar to lid 16 of FIG. 5) may be molded with a multiplicity of hollow vertical protrusions 43 (one for each island 40) to increase the vertical spacing between the islands 40 and the apertures 36 of the plates 34. Each protrusion 43 projects upwardly from the upper horizontal surface of the lid top 20*a*, and itself has a generally rectangular, horizontal flat top surface, on which is mounted one of the islands 40. As in FIGS. 3 and 4, the aperture-defining plate 34 is mounted on the lower (downwardly facing) horizontal surface of the lid top, and the apertures 36 are disposed in register with the protrusions 43, being thus also in register with the islands 40. Again as in FIG. 4, the gaps (here designated 42*a*) between the islands and the peripheries of their associated apertures are provided by the vertical spacing between the islands 40 and plate 34, since the islands 40 are larger than the apertures 36. In top plan view, the structure of FIG. 8 (like that of FIG. 4) is as shown in FIG. 3.

Figure 9:
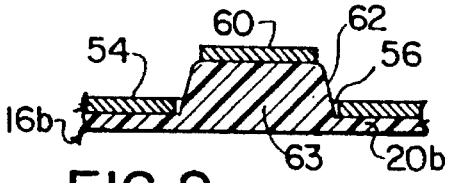
Figure 10:
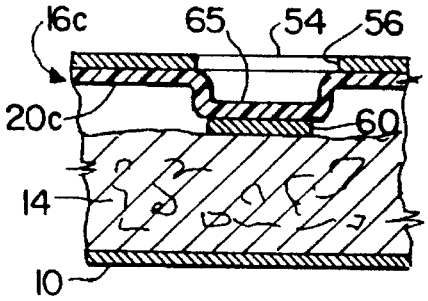

FIGS. 9 and 10 illustrate further embodiments of mode filters having vertical spacing between apertures and islands. In the structures of these latter figures, the conductive plate 54 defines an array of apertures 56 which are larger in area than the conductive islands 60, so that the arrangement of apertures and islands, in plan view, corresponds to FIG. 1. Each aperture and its associated island define an annular gap 62, which gap results both from the vertical spacing between apertures and islands and from the fact that the islands are smaller in area than (though conforming in shape and orientation to) the apertures.

More particularly, FIG. 9 shows a plastic lid 16*b* having a top 20*b* formed with a multiplicity of solid (rather than hollow) molded protrusions 63, i.e., one for each island 60, projecting upwardly from its upper horizontal surface, but otherwise similar to the above-described lid 16. Each protrusion has a flat horizontal top surface on which one of the islands 60 is mounted. The plate 54 is mounted on the main upper horizontal surface of the lid top 20*b*, in such position that the protrusions 63 respectively project upwardly through the apertures 56.

FIG. 10 shows a plastic lid 16*c* with a top 20*c* having a planar horizontal upper surface and a multiplicity of hollow protrusions 65 (one for each island 60) projecting downwardly from its lower surface. Each protrusion 65 has a flat, downwardly facing horizontal lower surface on which is mounted one of the islands 60, while the aperture-defining plate 54 is mounted on the upper surface of the top 20*c* with the apertures 56 in register with the protrusions 65. The latter protrusions may be so dimensioned that, when the lid 16*c* is placed on a tray 10, the islands 60 are substantially in contact with the top surface of the contained body 14 of foodstuff.

It will be seen that in all the embodiments of FIGS. 3, 4 and 8–10, the aperture-defining conductive plate (34 or 54) and the conductive islands (40 or 60) are respectively disposed in parallel, but vertically spaced, horizontal planes. In all of these embodiments, and (except where otherwise noted) in those that follow, both the plate and the island or islands may conveniently be fabricated of aluminum foil and mounted on a lid or other container wall of microwave-transparent dielectric material such as one of the plastics mentioned above.

Figure 14:
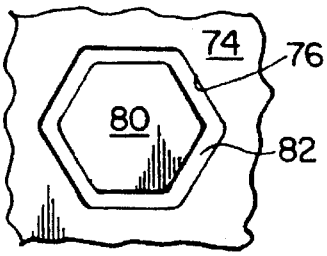
FIGS. 14 through 22 are fragmentary plan views of further configurations of mode filters in accordance with the invention.

In the mode filters of the invention, the islands and apertures may assume a number of geometries, among which are the following:

(a) polygonal (including polygonal with rounded apices), e.g., triangular, rectangular, pentagonal, hexagonal, etc. FIG. 14 shows a conductive plate 74 defining a hexagonal aperture 76 in which is disposed a smaller hexagonal conductive island 80 providing a hexagonal annular gap 82.

Figure 15:
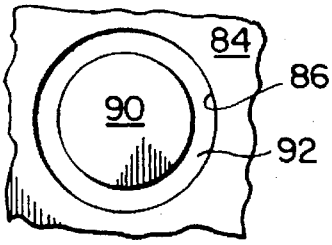
Figure 16:
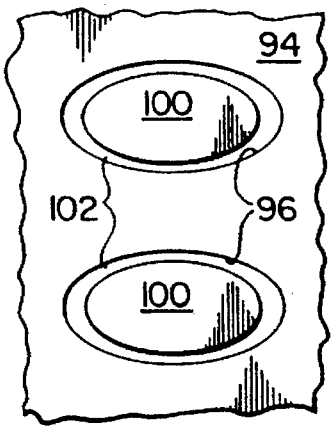

(b) round or elliptical (including epitrochoidal, multifoil, and similar variants). FIG. 15 shows a conductive plate 84 defining a circular aperture 86 in which is disposed a smaller circular conductive island 90, concentric with the periphery of aperture 86, such that a circular annular gap 92 is defined therebetween; FIG. 16 shows a conductive plate 94 defining an array of generally elliptical apertures 96 within each of which is disposed a smaller but con formal conductive island 100 to define, with the aperture periphery, a generally elliptical gap 102.

Figure 13:
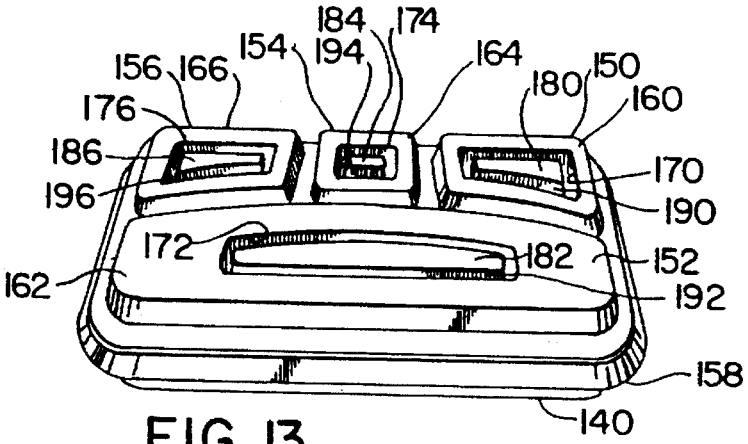
FIG. 13 is a perspective view of another container incorporating an embodiment of the invention.

(c) conformal (not necessarily definable in terms of simple geometric shapes), having a geometric resemblance to the shape of the food and/or container, and being intended to promote the propagation of higher modes within the food. FIG. 13 shows a multi-compartment container 140 in which each compartment is treated separately. The container has a series of metallic walls (not shown) which form compartments directly under regions 150, 152, 154 and 156 in a lid 158. The lid is made of a microwave dielectric material and is basically transparent to microwave energy. Each compartment has a corresponding top surface area in lid 158 and each top surface area has an approximately conformal plate of metallic foil. Such conformal plates are shown in FIG. 13 at 160, 162, 164 and 166. The area of each conformal plate is substantially equal to the lid top surface area on which it is mounted. Each conformal plate has a conformal central aperture (170, 172, 174, and 176, respectively) within which is disposed a smaller but conformal metal foil island (180, 182, 184, and 186, respectively) defining, with the associated aperture periphery, an annular gap (190, 192, 194, and 196, respectively). Each gap is dimensioned so as to provide the proper cooking energy and distribution to the foodstuff located in the compartment in question. For example, gap 190 is large with respect to region 150. On the other hand, the foodstuff in region 156 requires a different distribution of heating and so gap 196 is appropriately dimensioned.

Figure 17:
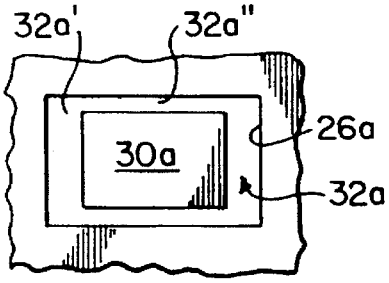
Figure 18:
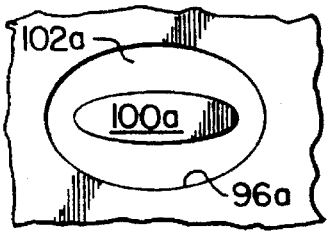
Figure 19:
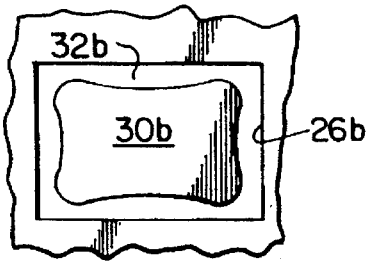
Figure 20:
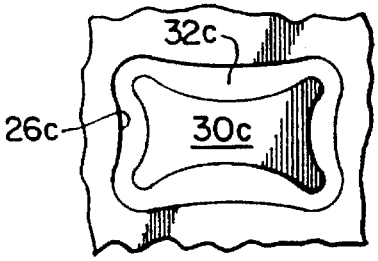
Figure 21:
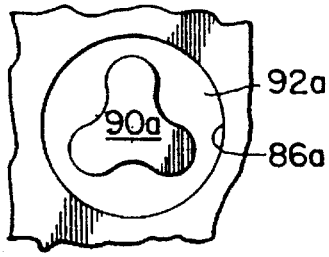

(d) nonconformal and/or nonuniform in gap width. In the abovedescribed embodiments, a substantially uniform gap width has been shown. However, the gap width may be nonuniform, as illustrated for example in FIG. 17, where a rectangular aperture 26*a* and a rectangular island 30*a* disposed therein have different aspect ratios so that the width of the short sides 32*a*' of the rectangular gap 32*a* between them is greater than the width of the long sides 32*a*" of the gap. Again, in FIG. 18, elliptical aperture 96*a* and elliptical island 100*a* positioned therewithin differ in configuration so that the gap 102*a* between them is of variable width. The geometry of the island may be nonconformal to the aperture periphery, as in FIG. 19, where a multilobed island 30*b* is disposed within a rectangular aperture 26*b* to define a variable-width gap 32*b;* in FIG. 20, where both the island 30*c* and the aperture 26*c* are nonconformal but once more define a variable-width gap 32*c;* and in FIG. 21, where a trifoliate island 90*a* is disposed within circular aperture 86*a* to define a variable-width gap 92*a*.

Figure 22:
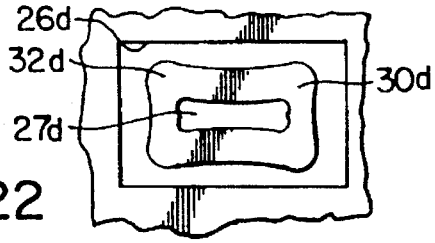

(e) with apertured islands, as shown in FIG. 22, where a multilobed island 30*d* is positioned in a rectangular aperture 26*d* to define therewith a gap 32*d* of variable width (similar to the arrangement shown in FIG. 19), but the island itself also has a central aperture 27*d*.

The various configurations illustrated in FIGS. 13–22, as will be understood, are merely exemplary of the diverse arrangements (with uniform or nonuniform gaps, and geometrically conformal or nonconformal island-aperture pairs) that may be employed in the structures of the present invention. Also, while for convenience only a single island-aperture pair is shown in most of these figures, it will be understood that an array comprising a multiplicity of such pairs may be provided in a complete mode-filtering structure, and that the pairs of such an array may (as hereinafter further discussed) be identical or nonidentical to each other dependent on the heating effect desired and the particular conditions of use.

Figure 11:
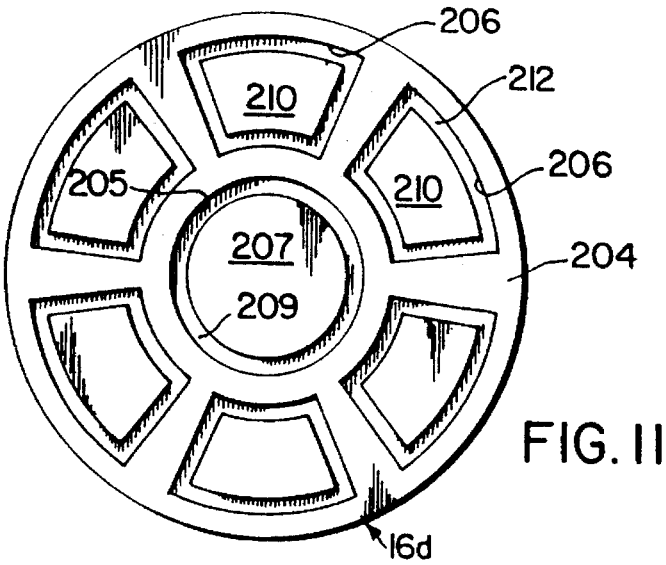
FIG. 11 is a top plan view of a container of circular plan, embodying the invention.

For a food article and/or container of rectangular cross-section, the island and aperture geometry will typically or commonly also be rectangular. For an article and/or container of cylindrical shape, the preferred island and aperture geometry will typically or commonly be based on a cylindrical coordinate system, i.e., divided into "cells" whose position is defined by radial and angular (harmonic) nodes. A system of the latter type is shown in FIG. 11, which is a top plan view of a cylindrical container having a plastic lid 16*d* with a planar circular top surface on which are mounted a conductive plate 204 defining five or six identical segment-shaped apertures 206 distributed in a radially symmetrical arrangement, and five or six conformally shaped but smaller conductive islands 210 respectively positioned in register with the apertures to define, with the aperture peripheries, five or six annular gaps 212, together with a central circular aperture 205 and island 207 defining a circular gap 209.

In the mode filters of the described embodiments of the invention, the minimum separation between apertures is dictated by the heating distribution desired in the food, by the mechanical ruggedness required by the application, and the amount of ohmic heating occurring in the metal defining the aperture array. In aperture arrays constructed from foil of household gauge and having rectangular apertures, the width of foil between the apertures (e.g., the width of the strips 28 in FIGS. 1–2) will typically be 5 mm or greater.

Figure 12:
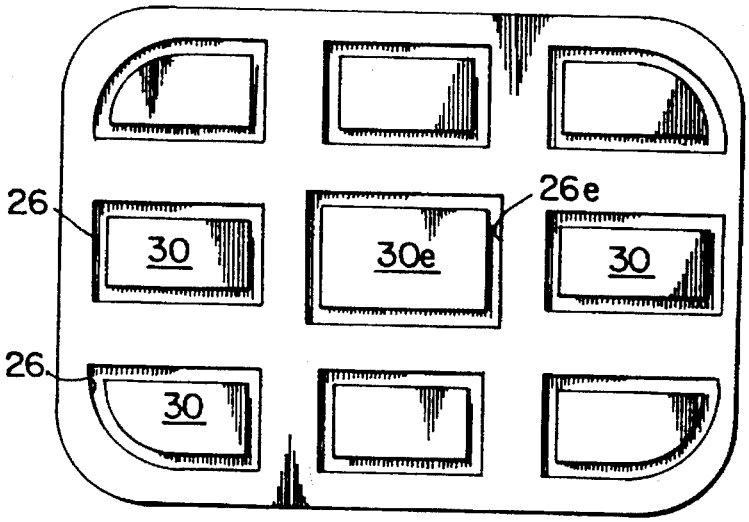
FIG. 12 is a top plan view of a further embodiment of the mode-filtering structure of the invention, having utility, for example, with a container as shown in FIG. 5.

Heating distributions over the plane of a mode filter comprised of a multiplicity of islands and apertures may be modified by varying differentially, over the cross-section of the structure, the island and/or aperture size, and/or the vertical displacement of the islands in relation to the apertures. For example, in the 3×3 array of apertures 26 and associated islands 30 shown in FIG. 12, in a mode-filtering structure otherwise of the general type shown in FIGS. 1–2 and 5–6, the central one of these apertures 26*e*, together with its associated island 30*e*, is made larger than the others, to control in a desired manner the heating in the central region of an adjacent body of foodstuff. The size of this central aperture and island correspond to a favorable higher mode in the foodstuff.

Figure 25:
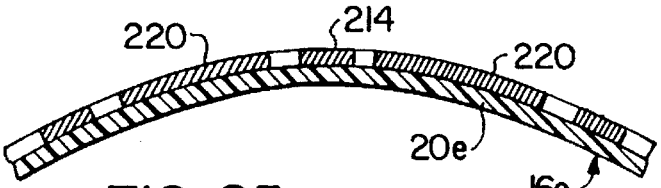
FIG. 25 is a fragmentary elevational sectional view of a curved microwave heating container lid incorporating a mode filter in accordance with the invention.
Figure 26:
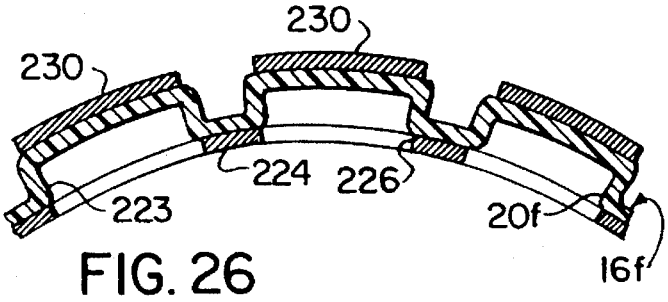
FIG. 26 is a similar view of a curved container lid incorporating another mode filter in accordance with the invention.

To conform better with the shape of food articles, the overall shape of a mode filter may be curved or corrugated, for example, rather than planar. FIGS. 25 and 26 show curved plastic container lids having mode filters in accordance with the invention. In FIG. 25, the upper surface of the top 20*e* of lid 16*e* has a smooth continuous convex curvature. An aperture-defining conductive plate 214 (generally similar to the plate 24 of FIG. 1) is mounted thereon, with the conductive islands 220 (generally similar to islands 30 of FIG. 1) also disposed on the same lid top surface. This curved mode filter corresponds to an arrangement (as shown, e.g., in FIGS. 1–2) wherein the conductive plate and islands lie in a common plane, and is embraced within the definition of a mode filter having coplanar plate and islands. In FIG. 26, the top 20*f* of the lid 16*f* has an overall upwardly convex curvature and is formed with a plurality of radially extending upward protrusions 223 each having an upper surface curved concentrically with the overall top curvature. A conductive plate 224, mounted on the lower surface of the lid top 20*f*, defines an array of apertures 226 respectively in register with the protrusions 223; a corresponding array of conductive islands 230 are mounted on the upper surfaces of the protrusions. The curved mode filter of FIG. 22 thus corresponds to arrangements (as shown, e.g., in FIGS. 3–4 and 8–10) wherein the plate and islands are respectively disposed in spaced parallel planes, and is embraced within the definition of parallel-plane plate arrangements.

Further in accordance with the invention, and as discussed above with reference to FIG. 7, a plurality of mode filters may be provided at different walls or surfaces of the same microwave heating container, e.g. for simultaneous treatment of multiple food surfaces. When used at the upper and lower surfaces of a body of foodstuff in a container, the mode-filtering structures employed may be two distinct, electrically isolated mode filters, or two mode filters having aperture arrays constructed from the same metallic sheet. When two electrically isolated mode filters are used, the remainder of the package or container is formed from dielectric material, so that the overall package may be considered by the consumer a "composite" rather than "foil" container. Electrically isolated mode filters may also be used at the upper and lower surfaces of a container having metallic sidewalls.

Figure 24:
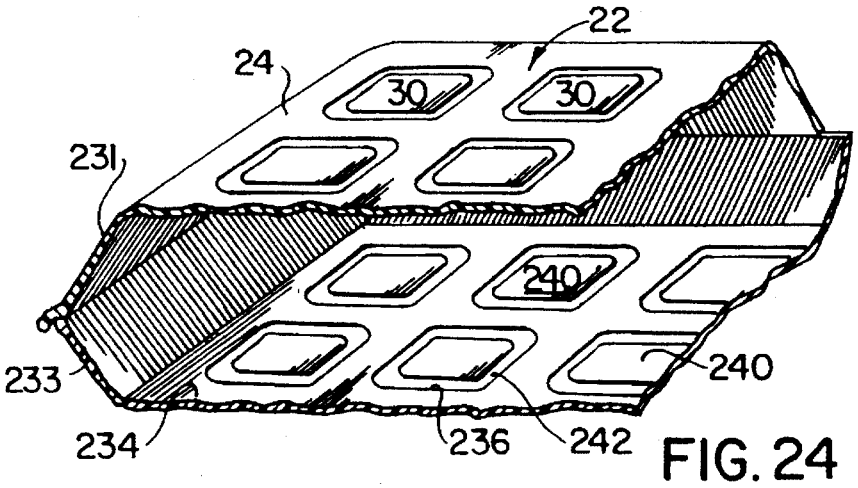
FIG. 24 is a fragmentary perspective view of another embodiment of the invention.

FIG. 24 shows a microwave heating container embodying the invention and including both top and bottom mode filters, between which is disposed the body of foodstuff to be heated. This container may be of the familiar "clamshell" type, viz. a typically thermoformed foamed plastic package having an upper portion 231 and a lower portion 233 joined by an integral hinge or folding region (not shown) formed along one side, and arranged to close positively or latch (by suitable and e.g. conventional means, also not shown, formed along their edge portions), the walls of the package being somewhat deformable. A mode-filtering structure of the type shown in FIGS. 1–2 (including aperture-defining plate 24 and islands 30) is mounted on the flat top of the package upper portion 231. Another similar mode-filtering structure 234, mounted on the flat bottom of the lower portion 233, defines an array of apertures 236 (which, in this embodiment, are identical in shape, size, and arrangement to, and are in register with, the apertures 26 of the top mode filter 22) and also includes a like plurality of aluminum foil islands 240, each defining with the periphery of its associated aperture a rectangular annular gap 242. These gaps 242 are equal in size and number to, and respectively in register with, the gaps 32 of the top mode filter 22.

As an alternative, an electrically isolated mode filter in or on a container lid may be used with a metallic container tray which incorporates the aperture array of a second mode filter. As a further alternative, one mode filter may be in close mechanical and electrical contact with a container incorporating an aperture array of a second mode filter in its base, or may be integral with it (as in a pouch type of construction). When two mode filters having aperture arrays constructed from the same sheet are used, this sheet may be folded in a U-shape to enclose the food article to be heated, as shown in fragmentary view in FIG. 23, which illustrates a U-bent aluminum foil/plastic laminate sheet 243 having a plurality of rectangular apertures 246 formed in the foil and a like plurality of smaller but conformal foil islands 250 supported on the plastic of the laminate within the apertures to define therewith rectangular annular gaps 252 of uniform width. By virtue of the U-bend 253 of the sheet 243, first and second arrays of the gap-defining apertures 246 and islands 250 are respectively disposed on opposite sides of a contained body (not shown) of foodstuff, so that these two arrays in effect constitute two mode filters acting at opposite surfaces of the foodstuff body. The edges of the sheet 243 may be suitably sealed together to form a pouch within which the body of foodstuff to be heated is enclosed.

Because microwave oven heating characteristics tend to be uneven in the vertical direction (owing to coupling effects caused by the presence of a glass tray or ceramic oven floor), different upper and lower mode-filter designs may be incorporated in the same container, i.e. to compensate for such vertical unevenness of heating characteristics. Compensation may be obtained by variation of relative island and aperture areas and/or of the vertical displacements of the island and aperture arrays.

While the foregoing embodiments have been chosen as illustrative of constructions which may be used with two mode filters, mode-filtering structures may also be used three-dimensionally, with mode filters located at all of the surfaces of a food.

The nature and principles of operation of the mode-filter containers of the invention may now be explained. In the described mode filter structures, as in the higher-order-mode-generating means of the aforementioned U.S. Pat. No. 4,866,234, the boundaries of each island or aperture define a set of modes with corresponding cross-sections. However, while an island array permits the entry of "lower" (or more fundamental) modes through strip-lines and slot-lines defined by the combination of islands, the entry of the "lower" modes is impeded by an aperture array. The aperture array may thus be perceived as analogous to a series of waveguide (or cavity) openings, each of which would effectively cut off or attenuate the lower modes.

It is useful to explain features of operation or function of a mode filter as herein contemplated, by analogy to a complete container as described in the last-mentioned copending application, with the boundaries of each mode filter aperture considered analogous to metallic container walls, and each associated mode filter island considered analogous to a higher-mode-generating metallic plate, as described in that application. In a mode filter wherein the islands are vertically displaced over the aperture array (relative to a body of food to be heated), the mode filter islands "feed" the aperture array so as to increase the amount of power (at the corresponding higher mode) available to the food over that which would enter the unmodified aperture array. It should be noted that in the absence of an island array, the use of apertures is regarded in the art as providing moderation (or reducing the amount of power available), such that an aperture array with small openings would be regarded essentially as a "shield."

A distinction exists between the vertical displacements (between the island and aperture arrays) which are possible with the mode filters of the present invention, over those obtaining between a higher-order-mode generating plate and metallic container walls of the containers of the last-mentioned patent. In the latter containers, there will seldom be occasion for the metallic plates to be positioned below the plane determined by the rim of the metallic container, and it would be clearly impractical for the plate to be immersed beneath the surface of the food. Contrastingly, since the aperture array of a mode filter as herein contemplated can be separated by an air gap from the food, the lower bound of island array vertical displacement relative to the aperture array is determined by the food surface.

Nevertheless, pursuing the aforementioned analogy, it is apparent that by differentially varying relative island and aperture size and/or island vertical displacement, food heating distributions may be varied over the mode filter cross-section.

Control of vertical heating gradients stems from the following considerations:

(a) Absorption/attenuation becomes particularly pronounced when the induced mode is cut off (i.e. when the condition of evanescent propagation obtains), this being the principal feature of the present invention.

(b) When a food contains layers with distinct dielectric properties, control of the mode structure can give rise to free propagation in a layer with a relatively nigh dielectric constant and cut off (steep attenuation/absorption) in a low dielectric constant layer.

(c) Thus, when a layer of pastry or batter/breading with a relatively low dielectric constant overlies a food of higher dielectric constant, intense heating may be selectively obtained in the surface layer. Thus, mode-filtering is a valuable tool in promoting browning or crispening effects, while minimizing undesirable overcooking of a good bulk.

(d) When the mode structure is fixed, as by metal wall boundary conditions, in the horizontal plane, the absorption coefficient of the food is determined by the mode cross-sectional dimensions.

(e) That is, for fixed food dielectric constant, and conductivity and dielectric losses, the absorption coefficient in the vertical axis increases with decreasing mode dimensions.

(f) By determining the mode dimensions, control is thus exerted over vertical heating gradients.

Figure 34:
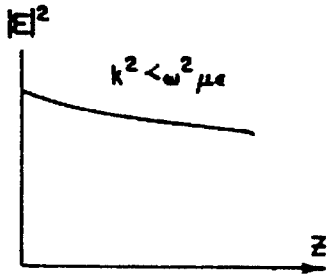
FIGS. 34–36 are graphs illustrating the relationship between absorption profile and cut-off of an induced mode.
Figure 35:
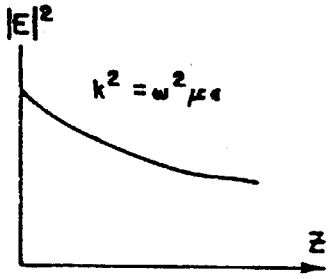
Figure 36:
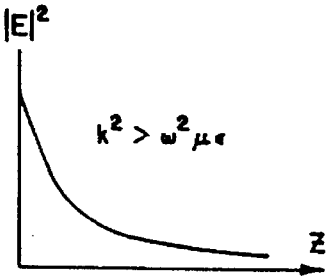

FIGS. 34–36 illustrate graphically the vertical absorption profile of microwave energy in a body of foodstuff adjacent a mode filter gap for conditions ranging from above cut off (FIG. 34) to below cut off (FIG. 36), where the body is sufficiently thick and/or absorptive so that the effects of reflection and/or propagation at opposite surfaces of the body can be ignored for purposes of the present analysis. Stated in general, it is the dimension of the individual mode filter gap (or open gap segment, in the bridged-gap structures described below with reference to FIG. 36) that determines whether a mode is in cut off for a food body of a particular dielectric constant, at a given wavelength (typically 2.45 GHz) of microwave energy.

FIGS. 34–36 may be explained by reference to a body of foodstuff positioned adjacent a planar horizontal gap- or aperture-defining electrically conductive plate, wherein the z axis is the axis of propagation into the food body (i.e., z=0 is the surface of the body adjacent the plate, and the distance along z in these graphs is penetration depth vertically into the body). In the graphs, $|E|^2$ (the squared magnitude of the electric field intensities, in the vectorial sense) is plotted against z, the intercept of the curves with the $|E|^2$ axis being the squared magnitude of a reference or surface intensity. Owing to the dependence of power absorption (heating intensity) on $|E|^2$, the curves in these graphs indicate the steepness of absorption/attenuation (in the vertical direction into the food) for the various conditions represented, showing that the steepness of the absorption/attenuation profile is much greater below cut off than above cut off.

$|E|^2$ is proportional to $e^{-2\alpha z}$, where $\alpha$ is defined by the relation $$\alpha^2=-\tfrac{1}{2}(\omega^2\mu\epsilon-k^2)+1/2[(\omega^2\mu\epsilon-k^2)^2+\omega^2\mu^2\sigma^2]^{1/2}$$

and $\omega=2\pi f$, f being frequency;

$\mu=\mu_r\mu_o$=magnetic permeability (typically, $\mu_r=1$ for non-magnetic materials);

$\mu_o=4\pi\times10^{-7}$ joule $(\text{sec})^2/(\text{coulomb})^2$-meter;

$\epsilon=\epsilon_r\epsilon_o$=dielectric constant, $\epsilon_r$ being the relative dielectric constant and $\epsilon_o$ being the free-space (electric) permittivity, $\epsilon_o=8.8541878\times10^{-12}$ $(\text{coulomb})^2$/joule-meter;

$\sigma$=conductivity.

Evanescent propagation is governed by an exponential law whose argument includes both the real component (±) $\alpha$ and a complex component (±) $\beta$, defined by the relation $$\beta^2=1/2(\omega^2\mu\epsilon-k^2)+1/2[(\omega^2\mu\epsilon-k^2)^2+\omega^2\mu^2\sigma^2]^{1/2}$$

which gives rise to a nearly periodic variation of energy absorption with depth of penetration. The curves shown in the graphs ignore $\beta$. For foods which are thick or highly absorptive, $\beta$ may be neglected. Thus, the curves should be understood as smoothed representations of the actual values involved.

It will be noted that the expressions for $\alpha^2$ and $\beta^2$ allow $\alpha$ and $\beta$ to assume positive or negative signs. The choice of a negative sign of $\alpha$ in the proportionality determining $|E|^2$ reflects the absorption of energy and concomitant decrease of $|E|^2$ with penetration. The existence of a component with a positive $\alpha$ term indicates either reflection at, or the entry of power from, an opposing surface. The quasi-periodic variation due to $\pm\beta$ follows from Euler's formula $$e^{\pm j\beta z}=\cos\beta z\pm j\sin\beta z$$

where $j=(-1)^{1/2}$. Also to be noted is the relationship of $\alpha$ and $\beta$ to the combined propagation constant p in the vertical axis, viz. $p=\alpha+j\beta$.

The free-space value of $\epsilon_r$ is unity. In foods, $\epsilon_r$ is largely determined by food moisture content or water activity, so that the value of $\epsilon_r$ for high-moisture foods will nearly approach that of water, for which (at a frequency of 2.45 GHz) $\epsilon_r$ varies from about 80 at 0° C. to about 55 at 100° C., the value for ice being approximately 4. For low-density, low-moisture-content food components such as partially precooked batters or coatings, the value of $\epsilon_r$ is about 5, varying by equilibration of their moisture contents with adjacent high-water-activity foods.

For any given mode of propagation of microwave energy, the condition for cut off is that $k^2$ (defined as the separation constant for the equations governing the components directed in the plane of the plate) be equal to or greater than $\omega^2\mu\epsilon$. From the well-known relations $c=(\mu_o\epsilon_o)^{-1/2}$ and $c=\lambda_o f$, where c is the speed of light and $\lambda_o$ is the free-space wavelength, it follows that $\omega^2\mu\epsilon=4\pi^2\epsilon_r/\lambda_o^2$ when $\mu_r=1$. Thus, the condition for cut off ($k^2\geqq\omega^2\mu\epsilon$) can be expressed as $k^2\geqq 4\pi^2/\lambda^2_{eff}$, where the effective wavelength $\lambda_{eff}=\lambda_o/\epsilon_r^{1/2}$. For f=2.45 GHz, $\lambda_o$=12.24 cm. When cut off occurs, the magnitude of the term $\alpha$ (governing the penetration of microwave energy into the food) increases substantially.

The value of $k^2$ is dependent on the geometry and dimensions of the gap or aperture as well as on the mode under consideration. In the simple case of a rectangular aperture having horizontal dimensions $L_x$, $L_y$, for the [m,n] mode, $$k^2=\pi^2\,[(m^2/L_x^2)+(n^2/L_y^2)]$$

and the condition for cut off is $$\pi^2[(m^2/L_x^2)+(n^2/L_y^2)]\geqq 4\pi^2/\lambda^2_{eff}.$$

Thus, for example, for the [0,1] or [1,0] mode, the condition for cut off is that the relevant dimension L (i.e., $L_x$ or $L_y$) be equal to or less than $\lambda_{eff}/2$. Again, in the case of a circular geometry, in which for the [m,n] mode $$k^2=j^2_{m,n}/r_o^2$$

where $j_{m,n}$ is the nth zero of the mth order Bessel function and $r_o$ is the radius of the aperture opening, the condition for cutoff in the [0,1] mode is that $r_o$ be equal to or less than $0.3827\lambda_{eff}$. In summary, critical dimensions for cut off for exemplary aperture geometries and modes are as follows:

| Geometry | Mode | Critical Dimension |
|---|---|---|
| Square ($L = L_x = L_y$) | [0,1], [1,0] | $L = \lambda_{eff}/2$ |
| " | [1,1] | $L = \lambda_{eff}/2^{1/2}$ |
| Rectangular ($L_y = qL_x$) | [1,1] | $L_x = \lambda_{eff}(1 + q^2)^{1/2}/2q$ |
| Circular | [0,1] | $r_o = 0.3827\lambda_{eff}$ |
| " | [1,1] | $r_o = 0.6098\lambda_{eff}$ |

The term $k^2$ is easily determined in rectangular and circular systems (tables of the zeros of Bessel functions are given in G. N. Watson, *A Treatise on the Theory of Bessel Functions,* Cambridge Univ. Press, 1922). The analysis is more complex for other gap/aperture geometries (e.g. ellipses), but the general proposition holds that cut off of a given mode occurs when the relevant horizontal dimension of the gap or aperture is equal to or less than a value determined by the gap/aperture geometry, the mode in question, and the dielectric constant of the food body or body portion of concern. Thus, where the objective is to achieve browning and crispening by provision of a condition below cut off, with resultant steepness of food heating profile, it is feasible to do so by appropriate dimensioning of the mode filter gaps or apertures, viz. by keeping such dimensioning below the maximum value for cut off.

Applying these considerations to the design of mode filters to achieve browning and crispening, it is observed that open, wide apertures are ineffective for this purpose, since large square or circular apertures will have low field intensities across them and should therefore fail to produce desired browning and crispening. By introducing islands in such apertures, higher harmonics result, and more intense fields may be expected across the narrowed gaps.

Evidently, narrow slots give the desired heating effects. Slot length will be $\leqq\lambda_{eff}/2$. For segmented slots the desired segment length will approximate to $\lambda_{eff}/2$. Curved slot length should likewise approximate to $\lambda_{eff}/2$. In the case of a round aperture with a small gap between island and plate, the circumference should be nearly (or less than) $\lambda_{eff}$. Larger gaps will allow resonance in the radial dimension. Similarly, it is expected that the line integral of gap length for narrow, uninterrupted rounded shapes will approach or be less than $\lambda_{eff}$.

In general, the width of a gap (in the island-aperture pairs or arrays) should be at least about 1 mm, to avoid excessively high field intensities. The length of the gap will usually be at least about 5 mm.

Stated with reference both to embodiments of the invention employing island-aperture (gap) pairs or arrays and to those employing annuli (further described below), the following general principles governing critical (cut-off) dimensions may be set forth:

Dimensions of narrow gaps or annuli: for gaps or annuli defined by a smooth curve lacking pronounced cusps or apices and encircling a closed area, cut off of the lowest order mode will occur when the line integral of the curve is less than one effective wavelength ($\lambda_{eff}$). If the ends of a smooth, open curve are not closely spaced, cut-off will correspond to a curve line integral of $\lambda_{eff}/2$. A closed curve with apices or cusps will be expected to have cut-off dimensions corresponding both to its circumference (one effective wavelength) and to its segments (each being $\lambda_{eff}/2$). For an odd number of equal segments, however, destructive interference may cause cancellation of the modes corresponding to them. An open curve with cusps or apices will similarly have its entire length as one cut-off dimension ($\lambda_{eff}/2$), and may also support higher order modes with cut-off dimensions defined as the distance bounded by two such apices or cusps (each segment being $\lambda_{eff}/2$).

Wide gaps or annuli: As with their narrow counterparts, wide gaps or annuli will support resonances over their lengths. However, they will also allow two-dimensional resonances, generally characterized by larger cut-off dimensions. Thus, in decreasing critical dimensions, cut-off will first occur for two-dimensional resonances, and be followed by cut-off in resonances determined by gap or annular lengths. By selecting dimensions which support resonances determined by gap or annular lengths, while providing cut-off of two-dimensional resonances, heating of the bulk of the absorber may be balanced against heating of its surfaces.

In practice, since at and adjacent the food surface some of the field will be in air, the wavelength will have a slightly greater value than $\lambda_{eff}$ as defined above. In determining cut-off dimensions for island-aperture gaps or annuli, a lower bound is provided by the bulk wavelength, taken as the free-space wavelength $\lambda_o$, divided by the square root of the absorber relative dielectric constant, here denoted as $\epsilon_{r(m)}$. If these structures were embedded well within the absorber bulk, this lower bound would accurately determine cut-off dimensions for the gaps or annuli. However, the coexistence of fields within the air surrounding an absorber causes wavelengths used in determining cut-off dimensions at the absorber surface (the locus of interest for browning and crispening effects) to be substantially larger than $\lambda_o/\epsilon_{r(m)}^{1/2}$.

A useful approximation for determining the effective dielectric constant $\epsilon_{eff}$ at the surface of a dielectric material is that suggested by S. B. Cohn, IEEE Trans. Microwave Theory and Techniques, MTT 17(10), 768 (1969), viz. the arithmetic average of the relative dielectric constant $\epsilon_{r(m)}$ of the dielectric material and the relative dielectric constant $\epsilon_{r(s)}$ of free space overlying its surface. Since the dielectric constant of free space assumes a value of $\epsilon_o$, the relative dielectric constant $\epsilon_{r(s)}$ must be unity. Thus, the approximated effective wavelength $\lambda_{eff}$ for purposes of determining cut-off dimensions for gaps or annuli at the surface of a food or other load to be heated is given by $$\lambda_{eff}=\lambda_o/[(1+\epsilon_{r(m)})/2]^{1/2}$$

Referring, then, by way of example, to the dimensions given above for the structure shown in FIG. 1 (a 5×4 array of rectangular apertures each 2.2×1.9 cm and enclosing an island 1.8×1.4 cm, such that the maximum gap width is 2.5 mm), the "narrow gap or annulus" considerations set forth above establish that the critical dimensions for cut off are a perimeter, or sum of gap length and width, equal to $\lambda_{eff}$, or either length or width equal to $\lambda_{eff}/2$. With the various gap lengths based on aperture (rather than island) dimensions, we obtain:

| $\lambda_{eff}$ (cm) | $(1+\epsilon_{r(m)})/2$ cut-off | $\epsilon_{r(m)}$ lower bound at cut-off |
|---|---|---|
| 3.8 | 10.4 | 19.8 |
| 4.1 | 8.9 | 16.8 |
| 4.4 | 7.7 | 14.5 |
| 8.2 | 2.2 | 3.5 |

For a food product having a batter or breaded coating with a dielectric constant of less than about 14, propagation in the coating will be in cut-off for all but the hypothetical mode corresponding to the perimeter dimension of the gap; propagation will not be in cut off in the underlying food bulk, however, because of its substantially greater dielectric constant.

For circular gaps or annuli, the critical dimensions are a diameter equal to $\lambda_{eff}/\pi$.

The control of horizontal plane heating distributions and of heating gradients in the "vertical" axis is increased, when the entry of radiation through other food surfaces is suppressed. This suppression may be obtained by the selection of overall mode-filter dimensions and separation, by the shape or contour of the mode-filter edges (as by introducing well known "choke" structures), and/or by the introduction of metal walls (which may be integral with the mode filter(s), and which may also incorporate mode filters).

Operation of the mode filters of this invention is typified by the following:

Considering first a single-mode filter array, i.e. at a single surface, modification of heating distributions in the horizontal plane of a container and/or food is generally obtained by positioning the island array over the aperture array, and by positioning the resulting structure over a metallic or composite container. The design principles used to obtain a particular heating pattern are similar to those used in the containers described in the aforementioned U.S. Pat. No. 4,866,234, except that there is less need (in the present invention) to compensate for the entry of "lower" modes.

When used with the crispening containers described in the aforementioned published European application under No. 246,041, the island array of a mode filter in accordance with the present invention may be vertically displaced above or below the aperture array. In this configuration, crispening may be obtained simultaneously at both the upper and lower surfaces of the food. A particularly efficacious configuration is that in which the islands are in contact with the food, but are displaced beneath the aperture array. When used for browning or crispening, a mode-filter will generally use island and aperture dimensions on the order of less than 2 cm on a side.

Figure 27:
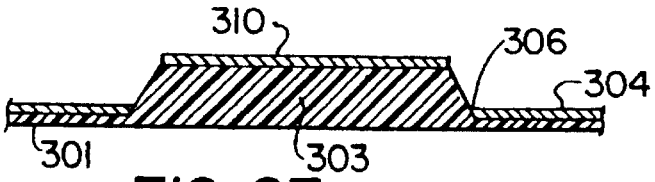
FIGS. 27 and 28 are fragmentary sectional elevational views of mode filters in accordance with the invention, formed in container bottoms.
Figure 28:
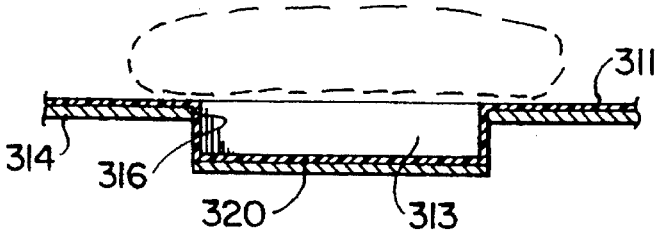

Examples of the just discussed embodiments of the invention, provided on the floors or bottoms of microwave heating container trays in association with stepped structures or protrusions formed therein, are shown in FIGS. 27 and 28. In FIG. 27, a dielectric-material (e.g., molded plastic) container bottom 301 is formed with one or more upward protrusions 303 having a planar upper horizontal surface spaced above the horizontal upper surface of the bottom. An aperture-defining conductive plate 304 is mounted on the latter surface, defining at least one aperture 306, through which protrusion 303 projects; a conductive island 310 is mounted on the upper surface of the protrusion, to define (with the aperture) an annular gap of uniform width, thus constituting a mode filter in accordance with the present invention. In FIG. 28, a dielectric-material container bottom 311 is formed with one or more downward protrusions 313 having a planar lower horizontal surface spaced below the horizontal lower surface of the bottom; aperture-defining conductive plate 314 is mounted on the latter surface, defining an aperture 316 through which protrusion 313 projects downwardly, while a conductive island 320 is mounted on the lower surface of the protrusion 313, again so as to define with the aperture periphery a uniform-width annular gap. Each of these mode filters of FIGS. 27 and 28, as will be understood, may include an array of apertures, islands and protrusions, only one being shown in each case for simplicity of illustration.

Figure 29:
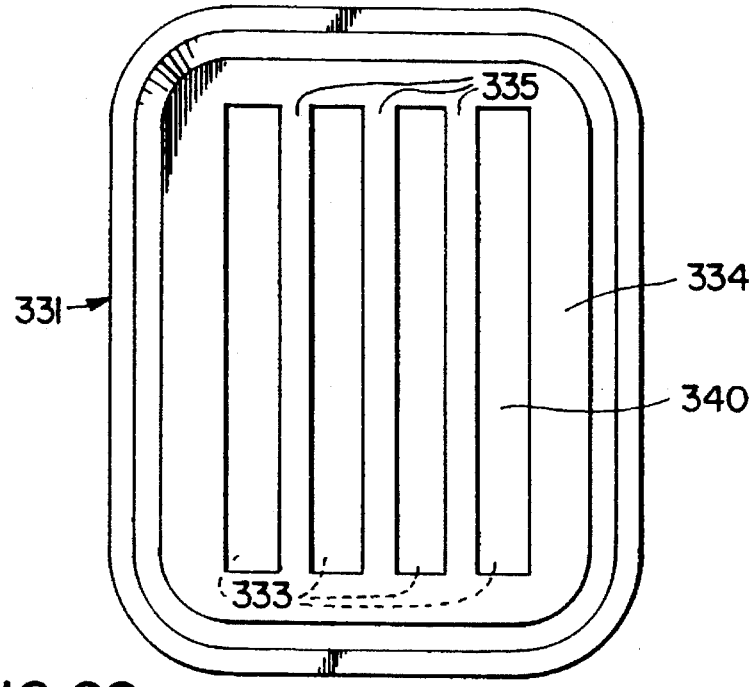
FIG. 29 is a top plan view of the container tray of still another embodiment of the invention.
Figure 30:
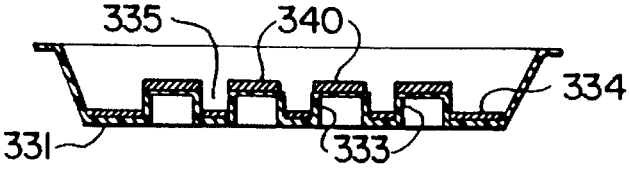
FIG. 30 is a sectional elevational view of the tray of FIG. 29.

Mode filter structures arranged for simultaneous treatment of multiple surfaces are of considerable interest for the browning or crispening of battered and breaded foods such as fish sticks, fried chicken, etc. In these arrangements, similarly to the containers of FIGS. 7, 23 and 24, one or more food articles are placed between two mode-filtering structures. The island and aperture dimensions are chosen so as to intensify heating at the food coating. Two types of browning or crispening may be obtained:

(A) "Uniform": The island arrays are close to, or in contact with the food surfaces, and the aperture arrays are either coplanar, or displaced "vertically" away from the food. This configuration may be used to give nearly uniform, intensified heating of the surfaces. When (as shown in FIGS. 29 and 30) the dielectric bottom 33 1 supporting the aperture-defining plate 334 and islands 340 is formed with inwardly projecting protrusions 333, the resulting channels 335 between the islands improve venting and drainage from the food during its microwave heating.

(B) "Grilling": The aperture arrays are relatively close to the food surfaces. The pattern of browning/crispening which results roughly corresponds to the metal areas of the aperture array. When the mode-filter islands are carried on outwardly projecting protrusions, the wells so formed improve venting, and allow for the collection of drainage from the food.

These and related configurations offer many advantages over so-called "susceptor" packages:

(a) Because heating is induced in the food rather than in the package itself, lower temperature materials may be used. A benefit of lower temperatures is the reduction of pyrolytic by-product generation.

(b) The control of heating distributions offered over the horizontal plane of the mode-filtering structures allows more uniform heating and/or browning and crispening effects to be obtained.

(c) The relatively high impedance presented by the structures provides more even distribution of heating over multiple food items. By variation of mode-filter design, selective heating may also be provided. Also, the attainment of desired results is less dependent on the particular oven used.

(d) Heating and/or browning and crispening effects can be "balanced" between the upper and lower food surfaces, by variation of mode-filter design.

(e) The overall shape of the mode-filtering structures can be modified to better conform with the product to be treated.

(f) Drainage and venting can be accommodated as an integral feature of mode-filter design. When supporting protrusions are generated by thermoforming, a more flexible package results, which is better able to conform to surface irregularities of the food.

(g) The heat-resisting and heat-distributing properties of the metal surfaces which may be used to contact the food minimize damage to the package resulting from localized "hot" regions, and reduce the hazard of contamination of the food by products generated through the heating of the container.

(h) Because the mode-filtering structures can be supported on a plastic dielectric, a variety of container or package shapes can be offered, owing to the versatility of plastic forming/fabricating methods.

The mode filters described above are a subset of a much broader set, which is conceptually linked also to the conductive indented structures of the last-mentioned European application. This much broader set may be characterized in the following features:

(1) A conductive area is made electrically distinct from surrounding or adjacent conductive areas. Modes corresponding to this distinct area are induced in a proximate foodstuff (or absorbing material). Modes not necessarily the same as those induced by this area but corresponding to the surrounding or adjacent conductive area are also induced in the foodstuff. All of these modes will be higher modes than those fundamental to the combination of the foodstuff and container. They may therefore be used to modify heating distributions within the food and/or to induce browning or crispening effects.

(2) The conductive area may be made distinct (following (1)) in several ways, which may be used singly or in combination, and which include the following:

(a) The conductive area may be separated from the surrounding or adjacent areas by an air-gap or dielectric-filled gap.

(b) The area may be conductively connected to the surrounding or adjacent areas, being raised or lowered in relation to the plane defined by these surrounding or adjacent areas, but with the vertical separation providing some measure of electrical distinctness (i.e. vertical phase relationship). This connection may be at one or more sides of a polygonal area, so that when all the sides are connected, the structures described in the aforementioned application Ser. No. 044,588 result.

(c) Electrical distinctness of such a conductively connected area may also be obtained by establishing an impedance (in a stripline/slotline sense) different in the areas from that of the connecting means, as by varying the width of this connecting means. Different impedances may also be obtained through proximity of the area or connecting means to food or another dielectric substance.

(3) One or a plurality of such combinations of a conductive area and surrounding or adjacent conductive areas may be used as described above. These combinations need not be of similar design, but may be varied in size or in the choice and/or dimensions of the separating gap or conductively connecting means.

In an illustrative example, mode filters were prepared from foil sheets which effectively incorporated a mode filter as herein contemplated in a structure as described in the aforementioned application Ser. No. 044,588. These mode filters were intended for the crispening of breaded and coated fish fillets. The foil areas contacting the fillets were of the same size and disposed in the same positions as the "islands" of mode filters previously used for the same purpose. However, the areas of contact were electrically integral with the foil sheets, such that two opposite sides of these rectangular areas were connected with the sheet, and upwardly displaced from it (i.e., towards the fillets). The other opposite sides were not connected, so that air gaps or slots existed at these sides. Crispening of the fish fillets was fully comparable to that obtained with the "island" constructions. While crispening can also be obtained, when the contacting areas are, in effect, folded tabs (joined to the foil sheets), caution must be exercised in the design of these structures to prevent arcing or localized scorching of surfaces of the food article. When a food is placed between two of the structures, the slots of the structures need not be in register.

Following from the number of island/aperture shapes possible, it is apparent that there exists an even larger number of combinations for which one or more sides of the polygonal "islands" are connected to the "aperture array." It should be mentioned that these structures may also be viewed as patterns of slots, such that the slots define tabs or other shapes, and may even define structures resembling slot/strip meander lines. Since a single slot produces a field maximum at its middle (and thus, localized heating in the same region), it is desirable that the slots be configured so as either to give a desired pattern of heating, or even heating. While the structures defined by the slots may have apices or be angular in nature, rounded or convoluted shapes may also be used.

Figure 31:
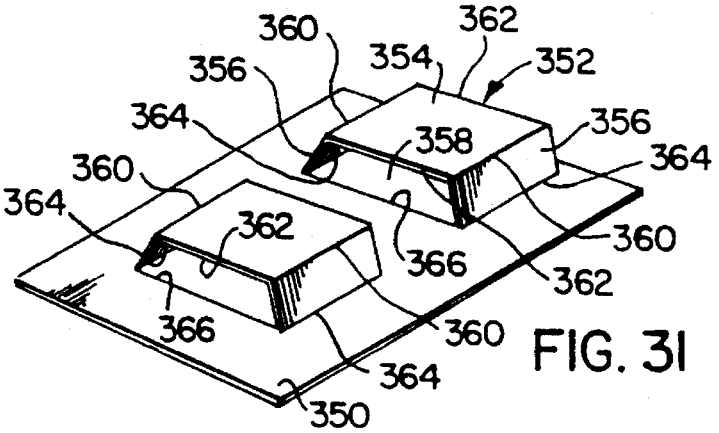
FIGS. 31 and 32 are fragmentary perspective views of two additional embodiments of the mode-filtering structures of the invention.
Figure 32:
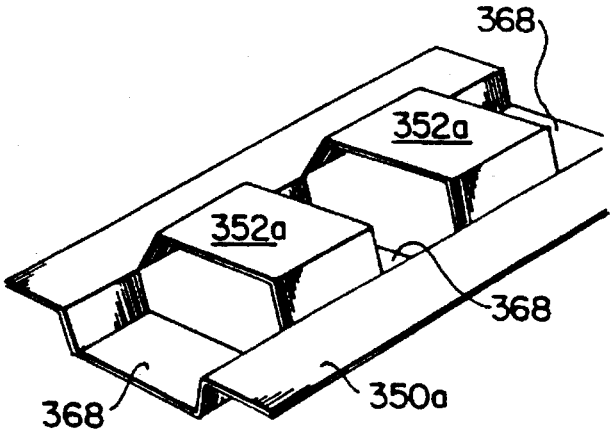
Figure 33:
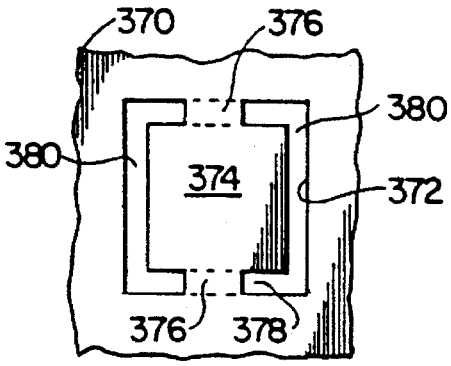
FIG. 33 is a view, similar to FIGS. 14–22, of yet another mode filter in accordance with the invention.

Further examples of structures in accordance with the invention, embodying some of the features just discussed, are shown in FIGS. 31–33. In FIG. 31, a metallic plate 350 is formed with a plurality of spaced-apart rectangular projections 352 each having a flat top 354 lying in a plane spaced from and parallel to the major surfaces of the plate. Opposed side walls 356 of each projection 352, integral with the projection and plate, connect the top 354 to the plate on two sides. On the other two sides of the top 354 there is an open gap portion 358 between the top and the plate. In this structure, each conductive "island" is the flat top 354 of a projection, its periphery consisting of bends 360 and gap top edges 362. Each "aperture" has a periphery defined by bends 364 and gap bottom edges 366. Walls 356 constitute conductive bridges spanning the gap between aperture and island. The open gap portions 358 provide dielectric isolation between aperture and island while the vertical displacement between top 354 and plate 350 due to phasing or electrical distance effects.

The structure of FIG. 31 is formed from a single sheet of metal by slitting and drawing to form the projections 352. In the modified structure of FIG. 32, also formed from a single metallic plate 350*a*, the plate portions 368 intermediate adjacent projections 352*a* are bent out of the plate major surface planes to an extent equal and opposite to the bending of the projections, so that drawing of the metal is not required.

FIG. 33 illustrates a planar mode filtering structure in which a metallic (conductive) plate 370 defining a rectangular aperture 372, and a metallic (conductive) island 374 of rectangular configuration, smaller than and disposed within the aperture, are connected by conductive bridge portions 376 spanning the gap 378 defined between the island and aperture peripheries. The plate, island and bridges are formed integrally from a single metal sheet (e.g. an aluminum foil sheet of suitable gauge) by cutting out from the sheet opposed C-shaped portions 380 of the gap 378. These portions 380 are open (microwave-transparent) portions or segments of the gap. A mode filter thus constituted provides effects comparable to those of mode filters in which there is complete isolation between island and aperture periphery, as in the structures of FIGS. 1–30 described above. A mode-filtering structure in accordance with the invention may have one such mode filter, or an array of these bridge-type mode filters, arranged for example in the same manner as the rectangular mode filters of FIG. 1.

The arrangement of FIG. 33 is merely exemplary of bridging arrangements by which islands are made integral with their associated aperture-defining conductive plates by spaced-apart conductive bridges spanning the annular gaps between aperture peripheries and islands. Such arrangements afford important advantages from a manufacturing standpoint, in that a complete mode-filtering assembly of apertures and islands can be formed integrally in a single sheet of aluminum foil or the like and mounted as a unit on a microwave-transparent container lid or other supporting surface. In these structures, the open gap portions or segments (380 in FIG. 33) are dimensioned to provide sharp attenuation in the vertical direction so as to achieve browning or crispening of the surface of the body of foodstuff being heated.

Figure 37:
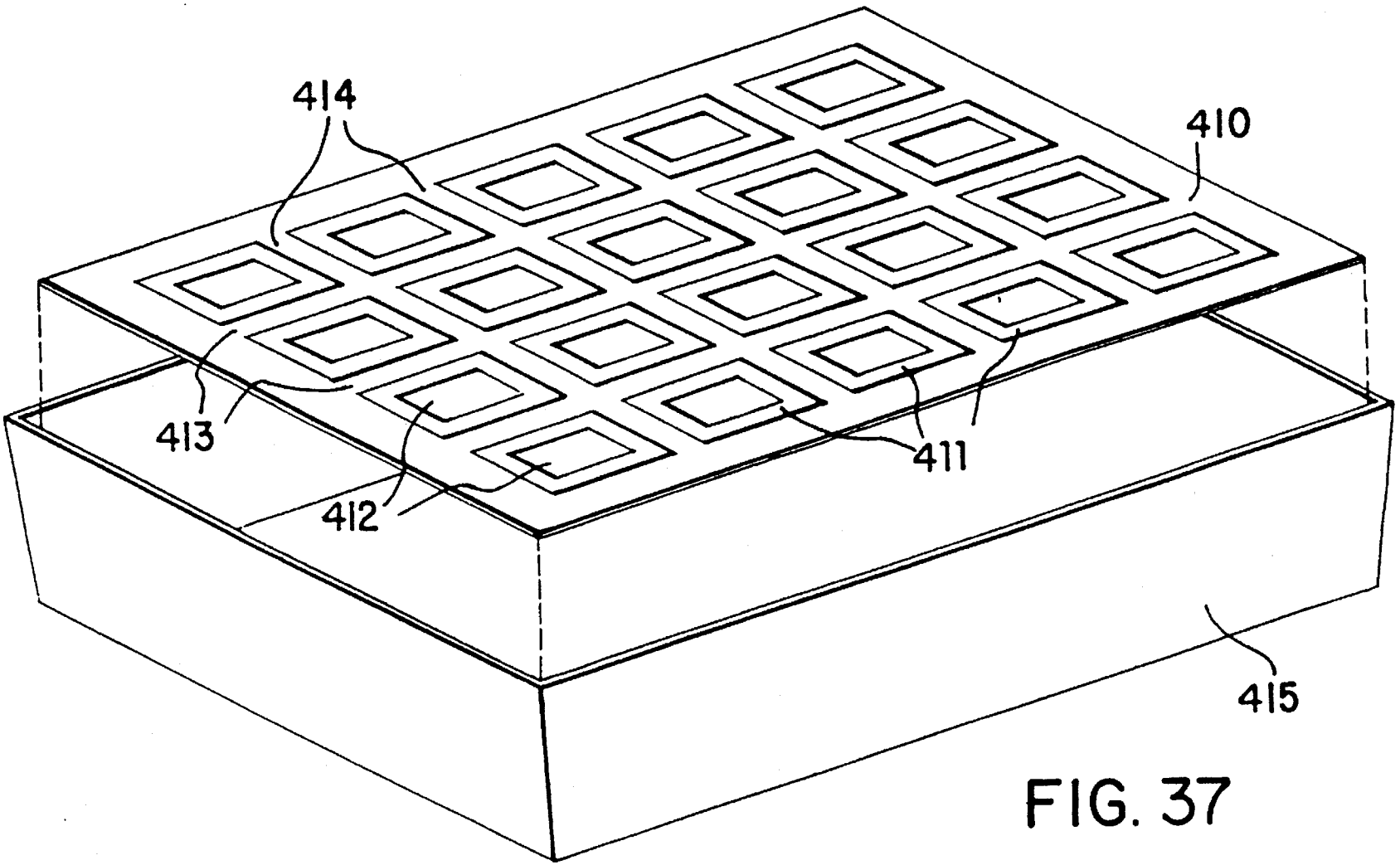
FIG. 37 is a perspective view of a device according to one embodiment of the invention, illustrating a manner of using such device.

FIG. 37 shows a device in the form of a thin sheet 410 of microwave-transparent material on which there is located an array of rectangular annuli 411 of aluminum or other metallic foil. Each annulus 411 defines an aperture 412 that remains microwave-transparent, as do the spaces 413 and 414 between the annuli.

The sheet 410 can be used in association with a standard food container 415, and may be placed therein beneath a food article (not shown) or above such article, depending upon which surface of the food article is to be subjected to an increased temperature for browning and/or crispening. Alternatively, if both the top and bottom surfaces are to be subjected to an increased temperature, two such sheets can be employed in the container 415, one below and one above the food article.

Each sheet 410 may be flexible so as to be able to conform to an irregularly shaped food article. For example, it may be made of polypropylene, polyester, polycarbonate or other low loss material that will be substantially transparent to microwave energy.

Alternatively, the sheet 410 can be more rigid, i.e. made of a low loss plastic foam or cardboard-like material. As a further alternative, it may be made of a ceramic or glass, provided that such material is substantially transparent to the microwave energy.

A sheet 410 can be embodied in the container 415 as a part thereof, e.g. as the bottom or as a lid, or as both. Alternatively, the sheet 410 can be a separate element that is employed by the user in conjunction with a container. For example, the user can place a standard food container (with a microwave-transparent bottom) on top of a sheet 410 in a microwave oven, or can place a sheet 410 on top of the food article after removing the conventional container lid.

Moreover, a sheet 410 can be used directly with a food article without need for a container at all. For example, a pizza can be heated by simply placing it on a sheet 410 in the microwave oven, provided the sheet 410 is sufficiently spaced above the oven floor to avoid arcing.

All these various possibilities are, however, subject to the requirement that the function of the sheet 410 (described in more detail below) is such that it should normally be located close to the food surface requiring enhanced heating in order to achieve the maximum performance, although desirable effects can be achieved with some gap between the food and the sheet.

The thickness of the metal film forming the metallic annuli 411 will be sufficient to prevent it functioning as a susceptor, such metal film being virtually entirely reflective of the microwave energy and absorbing negligible amounts of such energy. When using aluminum foil for the annuli, its thickness will preferably be about 6 or 7 microns, since this is a convenient rolling thickness for aluminum. However, from the viewpoint of remaining microwave-reflective and not acting as a susceptor, a thickness of as little as about 0.2 microns (as obtained by sputtering) might be used. This is in contrast to a thickness of about 0.01 microns which would absorb microwave energy and become heated.

Figure 38:
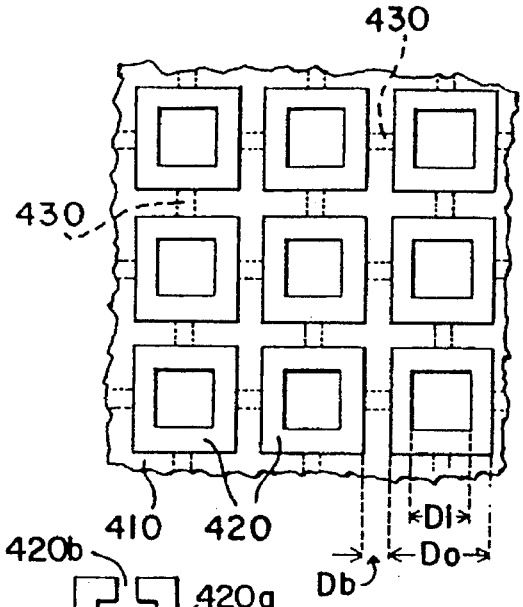
FIGS. 38, 38A, and 39–41 are fragmentary plan views of alternative embodiments.
Figure 38A:
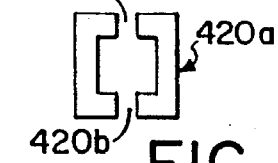
Figure 39:
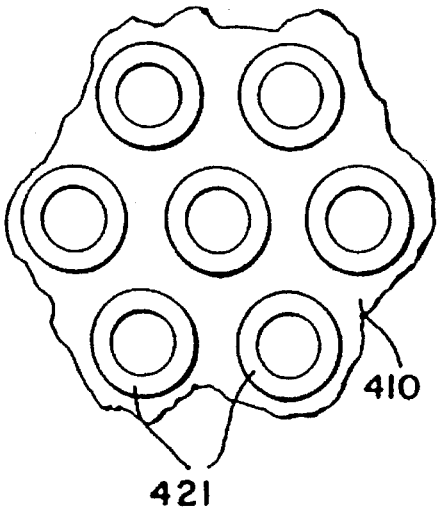
Figure 40:
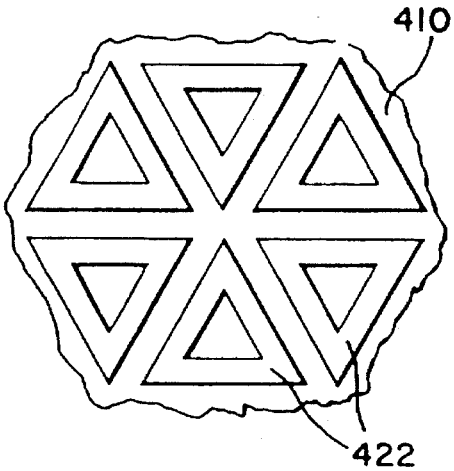
Figure 41:
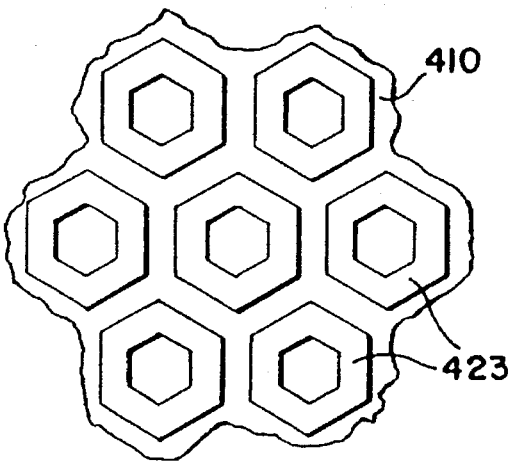

Before describing the function of the metallic annuli 411, it will be convenient to refer to alternative shapes that these annuli can take. FIG. 38 shows square annuli 420; FIG. 38A shows square annuli 420*a* interrupted at 420*b;* FIG. 39 shows circular annuli 421; FIG. 40 shows triangular annuli 422 and FIG. 41 shows hexagonal annuli 423. Any of these latter shapes can also have interruptions in the annuli, analagous to those of FIG. 38A, and such interruptions need not necessarily be two in number, but may be a single interruption or more than two interruptions. Moreover, the shape of the aperture defined by the annulus need not necessarily conform to the outer shape of the annulus. For example, a circular aperture in a square annulus can be used. Mixtures of these different shapes in a given array are possible, as well as modifications in the arrangement of the array and variations in the sizes of the different shapes in a given array. For example, alternate rows of the square annuli 420 in FIG. 38 can be staggered, to cause the microwave-transparent material between the annuli to trace out tortuous paths and avoiding long straight paths. Moreover, it is to be understood that the shapes of the annuli may only approximate the geometric shapes mentioned, and that normally the sharp corners that have been shown in the drawings for simplicity will be avoided by rounding to reduce the risk of arcing, and, as indicated above, the annuli can tolerate some measure of interruption while still effectively defining an aperture.

For discussion of the function of these annuli, it will be convenient to begin with the simple example of the square shape shown in FIG. 38, showing dimensions Di, Do and Db that respectively designate the inside distance of each annulus, i.e. the aperture width, the outside distance or the external width of each annulus, and the distance between adjacent annuli (assuming a symmetrically spaced array).

The function of the annuli is to set up a condition in which the aperture in each annulus causes the modes of microwave energy that propagate through the apertures to be in cut-off for air and for substances containing substantial quantities of air, e.g. batter, bread crumbs, pastry, etc., of which the surface layer of the food article will likely be composed, but preferably not to be in cut-off for the main portion of the food article inwardly of its surface layer.

For example, the wavelength in air of the microwave energy at the standard frequency of 2.45 GHz is approximately 12.24 cm, whereas in the food bulk (which will normally be composed mainly of water which has a relative dielectric constant of the order of 80), the wavelength will be in a range from about 1.3 cm (pure water) to about 2.0 cm, depending on the proportion of water in the food. It is to be understood that these values and those given below are necessarily approximate and can vary quite widely with the nature of the food or other article being heated. If the surface layer is of a substance different from the main portion of the food article, the wavelength in such surface layer will normally be somewhere in between that of air and that of the main portion of the article. The value of relative dielectric constant $\epsilon_r$ for such a layer will vary (owing, as mentioned above, to equilibration of a relatively low initial surface layer water activity with that of the underlying food); an exemplary low-end value of $\epsilon_r$ for coatings (such as batters and the like) subject to these considerations is 5. More broadly, an illustrative (but non-limiting) range of $\epsilon_r$ for a wide range of surface layers is 1.5–16, for which the corresponding range of wavelengths (at 2.45 GHz) is 10.0–3.0 cm. For example, a crumb coating or puff pastry crust, which includes a large number of air pockets, can typically have an overall relative dielectric constant that will result in a wavelength of the order of 8.0–10.0 cm. A more dense coating, e.g. a batter, on the other hand, can typically produce a wavelength more of the order of about 3.0–5.0 cm, although the wavelength may vary beyond this range depending on the exact nature of the coating. It follows that the dimensions of the annuli can be tailored to specific foods and coatings (surface layers) once their approximate relative dielectric constants are known, or by trial and error, in order to arrange that the apertures, i.e. the width dimension Di, should be such that some of the modes of microwave energy that propagate through the apertures will be below cut-off, i.e. commonly referred to as "in" cut-off, in the surface layer (and in air), but above ("not in") cut-off in the main portion of the food itself. It will be appreciated that in order to achieve the in cut-off condition for the [1,0] and [0,1] modes the dimension Di in the case of a rectangular structure must be smaller than half the wavelength in the substance concerned. Hence, to tabulate these numerical considerations, the half wavelengths will be

| | |
|---|---|
| bulk food | 0.65–1.0 cm |
| food surface coating | 1.0–3.0 cm |
| air | 6.0 cm |

Under these conditions, a good choice for the value of Di will be in the range of 10–16 mm, preferably about 12–14 mm, because this value should achieve a situation where the dominant modes of microwave energy that propagate through the apertures are in cut-off for the surface coating (and air) while not in cut-off for the bulk of the food. On the other hand, if it is not important in a particular situation for the fundamental modes not to be in cut-off in the bulk of the food, the lower end of this range can be extended down, e.g. to 5 or 6 mm. By the same token, if the surface coating of the food has a relatively low dielectric constant, the upper end of this range can be extended up, e.g. to about 20–25 mm.

It is important to reiterate that the numerical values given above are only examples and can be modified as needed to suit specific conditions, and in particular the specific nature of the food to be heated.

When the annuli are not square, e.g. one of the shapes shown in FIGS. 37, 39, 40, or 41, the effective width dimension to be considered from the viewpoint of making the aperture small enough to ensure cut-off in the surface layer (i.e., equivalent to the dimension Di) will be the greater internal length in the case of a rectangular annulus (FIG. 37), the internal diameter in the case of a circular annulus (FIG. 39), the height of the internal triangle in the case of a triangular annulus (FIG. 40), and the distance between a pair of opposite inside faces in the case of the hexagonal annulus (FIG. 41).

Moreover, the "smaller than half the wavelength" criterion is strictly true only for square or rectangular apertures. For circular apertures it becomes more complicated (for example, for the TE01 mode the cut-off wavelength $\lambda_{co}=\pi D/2.4048$, where D is the diameter of the aperture), and even more complicated for other geometries. However, to gain a general condition for cut-off dimensions, suffice to say that the largest dimension of the aperture corresponds to approximately half a wavelength, and more exact dimensions can be determined by routine testing.

Figure 42:
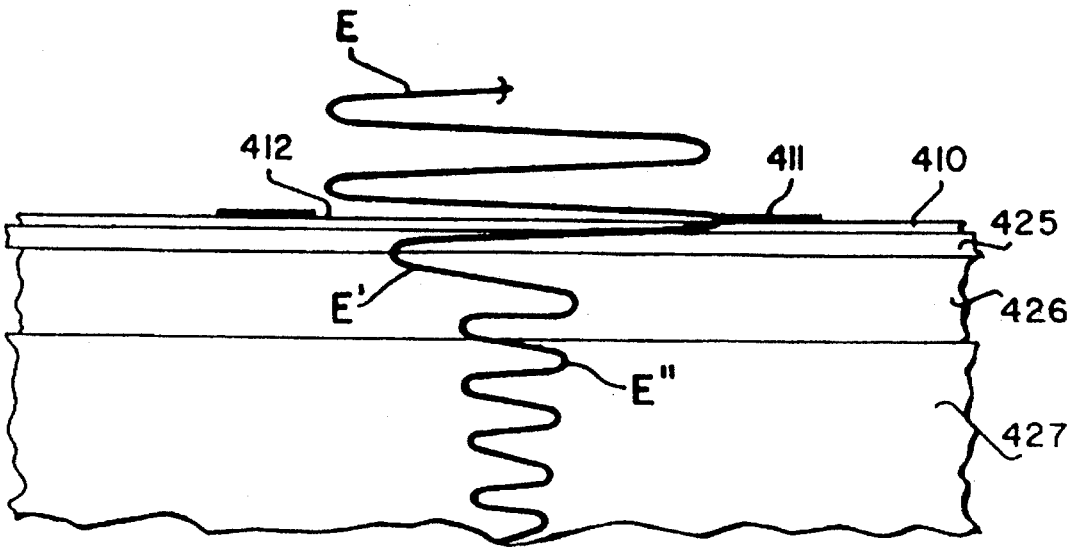
FIG. 42 is an illustrative diagram.

The condition of cut-off is illustrated diagrammatically in FIG. 42, which snows energy E entering the sheet 410. In this drawing, the sizes of the waves shown are intended to represent their respective amplitudes rather than their spatial locations. The energy E passes through an aperture 412 in one of the annuli 411. First it encounters an air gap 425, where there is attenuation per unit distance travelled (because the energy is in cut-off). Then the remaining energy E' enters a surface layer 426 where it is still in cut-off. Finally the remaining energy E" enters the main portion 427 of the food article, where it is no longer in cut-off and hence there is much less attenuation per unit distance due only to absorption.

The air gap 425 between the structure and the food is kept as short as possible, because the field decays evanescently in air, and the objective is that the majority of the energy should be absorbed in the surface layer 426.

As shown in FIG. 42, the energy E" that does remain to be absorbed by the main portion 427 of the food article will heat the same more uniformly in the depth direction of propagation, which is desirable, because the main portion of the food article will normally have a greater depth dimension than its surface layer.

The overall result is thus increased heating per unit volume in the surface layer 426 relative to the heating per unit volume in the main portion 427 and hence the attainment by the surface layer of a relatively high temperature (with a consequent browning or crispening effect) and the more uniform absorption of heat (at a lower temperature) by the main portion so that the inner parts of this main portion, which are relatively remote from the surface layer, are not entirely unheated.

Taking the example of the FIG. 38 array with a value of Di=10–14 mm, a convenient value for Do would be about 20–25 mm, and that for Db about 4–5 mm, with a minimum of about 3 mm. If the value of Db is made too small, there is a danger of arcing. If Db is made too large, the microwave energy will tend to be propagated through the spaces 413 and 414 instead of through the apertures 412. Assuming that the relative dielectric constant is within the exemplary range of values (1.5–16) mentioned above, as long as Db is no greater than about 6 mm, these spaces will also be in cut-off for air and the surface layer. On the other hand, the fact that these spaces 413, 414 are elongate may permit some of the energy to propagate through them. If this effect is found to be disadvantageous, it can be reduced by staggering the annuli to create more tortuous paths between the annuli as shown in FIGS. 39 and 41. It has also been found that good results are obtained from the device when the annuli are interconnected with each other (as shown, for example, in broken lines at 430 in FIG. 38) by similar microwave-reflective, substantially non-absorptive material. Such a layout of interconnected annuli enables the whole array to be stamped out in a single operation from a sheet of aluminum foil and mounted as a unit on the substrate 410.

Another way of viewing the effect of the arrays of annuli is to consider them as generators of higher order modes of microwave energy.

The embodiments with continuous, substantially straight open lines of microwave-transparent material (FIGS. 37, 38 and 40) allow more lower order modes to propagate and hence tend to achieve more bulk heating (which may be desired in some cases, depending on the nature, especially the water content, of the food article). This effect can be reduced by avoiding such open lines, as in FIGS. 39 and 41, or by staggering the rows of annuli in FIGS. 37, 38 or 40.

The embodiments of the invention so far described and illustrated have taken the form of an array of metallic structures on a microwave transparent sheet. However, instead of forming the apertures necessary to achieve cut-off by means of shapes formed of thin reflective, metallic shapes or configurations, the invention can also be practiced by defining the apertures by means of shapes or configurations of a material that differs from the microwave transparent sheet in some other electromagnetic property, such as conductivity, lossiness, dielectric constant, spatial thickness, a stepwise discontinuity or a magnetic property, as explained in the published European applications referred to above.

EXPERIMENT 1

A first experiment was carried out in a square container with side walls and a lid of aluminum, and a bottom of 10 mil microwave-transparent polycarbonate, so that all the energy would enter the container through its bottom. The dimensions of the container were 110 mm×110 mm×27 mm. To compare the invention with the prior art, two different square arrays "A" and "B" were used. In array "A" (prior art), each annulus was completely filled in, i.e. it became an island with no aperture, and in array "B" (according to the invention) there were apertures as in FIGS. 37 and 38. In both cases, Do=20 mm and Db=5 mm. The value of Di was

| Array | Di in mm |
|---|---|
| A | o |
| B | 14 |

Each array had nine bodies (islands in the case of array "A" and annuli in the case of array "B") arranged in a square, non-staggered layout as in FIG. 38.

Figure 43:
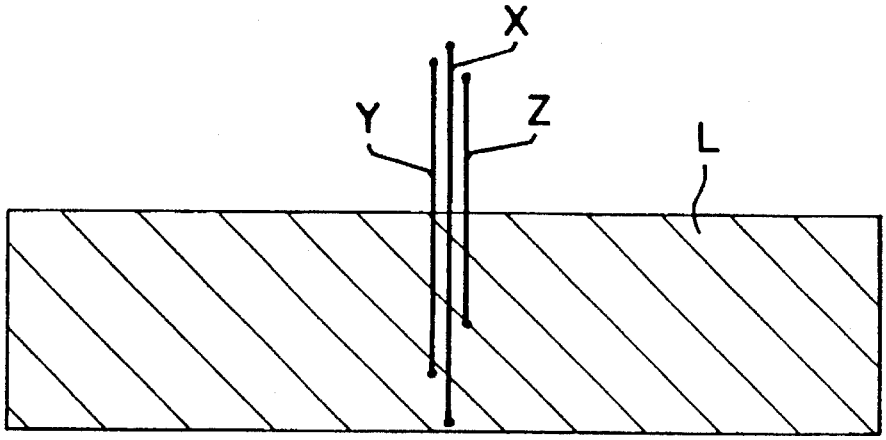
FIG. 43 is a diagram explaining an experiment.

Both tests were carried out under otherwise identical conditions, namely with a uniform load of 315 g of Cream of Wheat* cereal made by Nabisco Co. and with heating on full power in a Sanyo, Cuisine-Master* 700-watt microwave oven for three minutes. As shown in FIG. 43, temperature probes were passed through rigid plastic tubing into the center of the load L which completely filled the container, probe "X" being at or very near to the bottom, probe "Y" at three quarter of the depth of the load and probe "Z" at half the depth of the load.

*Trade Marks

The temperatures measured are shown diagrammatically in FIGS. 44A and 44B respectively, and it will be noted that the difference after three minutes between curve "X" (corresponding to probe "X") and curves "Y" and "Z" (corresponding respectively to probes "Y" and "Z") reached about 26° C. in FIG. 44B in constrast to about 5° C. in FIG. 44A. Also, the absolute value of the temperature of curve "X" was significantly higher. The 5° C. advantage of curve X over curve "Y" in FIG. 44A is attributable to the normal attenuation of the microwave energy as it passes through the load, but is considered insufficient to produce the desired browning or crispening.

It will be appreciated that, since the load was a uniform mass of Cream of Wheat* cereal, the load had a surface layer that did not differ significantly in nature (and hence in relative dielectric constant) from its main portion. However, the experiment nevertheless demonstrated the significantly increased surface temperatures that can be achieved with an array according to the present invention, even in the absence of a difference of dielectric constant between the surface layer and the main portion of the load. When such a difference in relative dielectric constant is also present, as in Experiment 2, the temperature difference between the surface layer and the main portion of the food is expected to be even more pronounced.

*Trade Marks

EXPERIMENT 2

A second experiment was conducted using different food articles, each having a different type of surface layer requiring browning or crispening, while varying the shapes of the annuli and hence the apertures.

For example, a container of frozen, battered and crumb-coated fish (haddock) was heated first using the hexagonal annuli and then using the square annuli. It was found that, when using the square annuli, it was sometimes best to use a different aperture dimension on the top surface from that used on the bottom.

This fish article had a flat bottom surface and rounded top and sides, and weighed approximately 190 g. It was placed in a microwave-transparent container, the base of which was fitted with an array of 28 (4×7) square annuli of dimensions Do=20 mm and Di=10 mm. A similar structure was placed over the top of the article, i.e. 28 (4×7) square annuli, but with dimensions Do=20 mm, Di=13 mm. The assembly was heated for 4½ minutes on full power in the same 700-watt oven. The result was a product in which the fish itself was uniformly heated to an appropriate temperature for serving, but not overcooked, while the surface appropriately crispened.

EXPERIMENT 3

This experiment was conducted in a 750 watt Gerling Oven model GL701(MPS 229-10)*. The container was square with dimensions of length 88 mm, width 88 mm and height 30 mm, and was made of brass to ensure that all the microwave energy entered the load from the top.

*Trade Marks

A first load used was purified agar in fine granular form dissolved in hot water to provide a gel density of 1.03 g/ml (sold as "Bacto-Agar"* by Difco Laboratories, Detroit, Mich., U.S.A.)

*Trade Marks

First runs on full power for 20 seconds with an unmodified container, i.e. no lid, and with different depths of load, showed in all instances the usual lateral disuniformity of heating, i.e. a cold center resulting from the dominant influence of the fundamental modes.

Corresponding runs on full power for 20 seconds with a mode-filtering array as shown in FIGS. 37 and 38 extending across the top of the load in contact with the load surface exhibited a more uniform heat distribution across the surface of the load, including significantly more heating in the central area.

The temperature measurements were taken by means of an AGA THERMOVISION Infrared Camera Model 780* and processed with a VIEWS CAN LTD. Scan Converter 700* and Viewsoft* Software.

*Trade Marks

Variations in the heating patterns were observed for different depths of load, i.e. for a depth of 6–7 mm (the theoretically minimum absorption depth) and for a depth of 10–11 mm (the theoretically maximum absorption depth). The effect of depth on energy absorption is the subject of Canadian patent application Serial No. 590,860 filed Feb. 13, 1989 (U.S. patent application Ser. No. 359,589 filed Jun. 1, 1989). It was found that, while there were differences in the heating effect with different depths of load, at all depths the tests conducted with a mode-filtering array in accordance with the present invention exhibited more uniform lateral uniformity of heating effect than those tests without such an array.

In order to observe the heating distribution in the vertical direction, the experiment employed a LUXTRON 750* Fluoroptic Thermometry System using a pair of probes. One probe was positioned 2 mm below the sample surface and the other 5 mm below the sample surface. Both were in the center of the sample in the length and width directions. The first probe effectively measured the "surface" temperature. These dimensions were maintained regardless of the depth of the load, which was either 6 mm or 10 mm. Measurement of the "surface" temperature by means of a probe that was actually 2 mm below the surface was required by the finite dimensions of the probe itself and in order to minimise the surface cooling effect.

*Trade Marks

The loads used were pastry (Gainborough Easi-dough*) rolled to a uniform depth of either 6 mm or 10 mm.

*Trade Marks

First runs were conducted in the same brass container with no array on top of the load. With full power the surface to bulk temperature differential at the end of 120 seconds was approximately 20° C. for a load of 6 mm depth and approximately 10° C. for a load of 10 mm depth. Effective crispening was not achieved.

Similar runs were conducted with various arrays in contact with the load.

Figure 45:
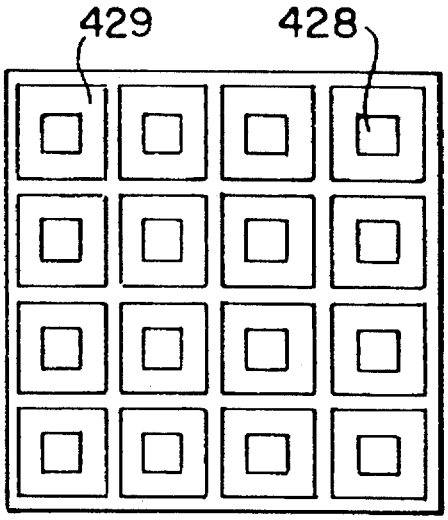
FIGS. 45–48 show different arrays that were used in Experiment 3 described below.
Figure 46:
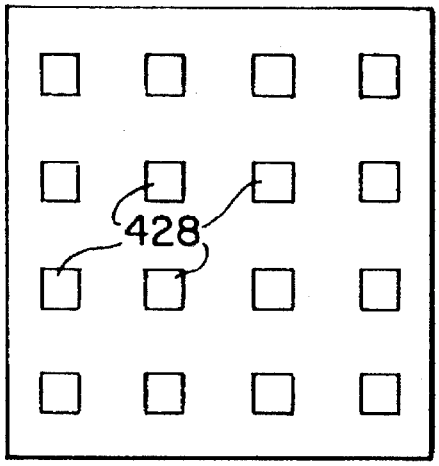
Figure 47:
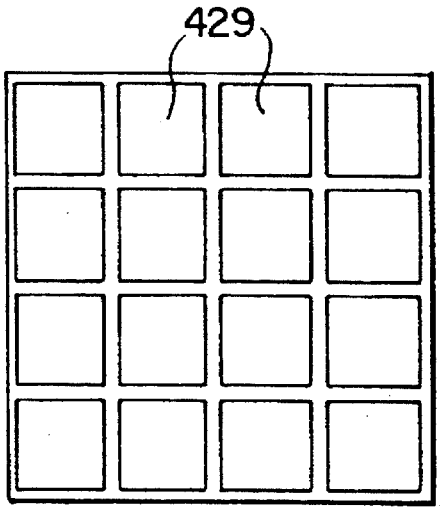

The array used (FIG. 45), which is basically similar in structure to FIG. 1, was separated into two parts, namely an array of islands 428 (FIG. 46) and an array of apertures 429 (FIG. 47). Three samples were tested under identical conditions, one with the island array (FIG. 46) alone, a second with the aperture array (FIG. 47) alone, and a third with these two arrays combined to provide the composite array of FIG. 45. It was found that neither of the single arrays when used individually was effective. However the combination produced a mode-filtering array that provided uniformity of heating across the surface of the pastry and an intensification of heat at the surface, i.e. a non-uniformity of heating in the vertical direction, sufficient to achieve satisfactory browning across the entire surface.

As measured by the probes the surface to bulk temperature differentials were approximately 45° C. and 38° C. for the 6 mm and 10 mm deep samples, respectively.

Figure 48:
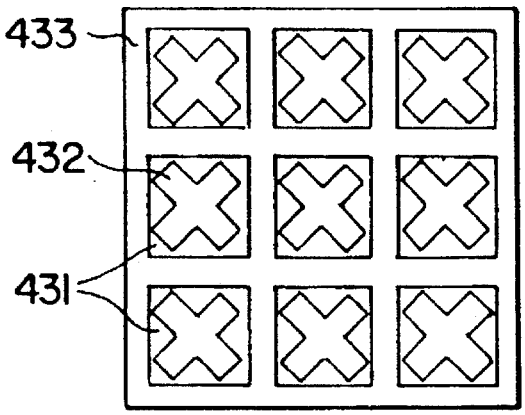

A further run was conducted using a pastry load of 10 mm depth and a mode-filtering array as shown in FIG. 48 having metal "annuli" 431 of such a shape as to define cruciform apertures 432, these annuli being arrayed on a sheet 433 of microwave-transparent material. The difference between the surface and bulk temperatures was already approximately 35° C. after 20 seconds heating at full power and remained at about this value as heating progressed. The array of FIG. 48 was tested in order to demonstrate that the interior shape of the annulus, i.e. the aperture, in this case cruciform, need not necessarily conform to the outer shape of the annulus, in this case square.

While the theory postulated above, namely that the improved surface heating that the above experiments have demonstrated to be obtainable follows principally from the fact that some of the modes of microwave energy that propagate through the apertures are in cut-off in the surface layer, is the best explanation currently known to applicants, it is desired to point out that other factors may be at work in a system as complex as that involved when microwave energy propagates in confined spaces. For example, the improved surface heating that has been observed may result from a combination of effects, including not only the size of the aperture in each annulus but also the width of the microwave-reflective material forming the annuli and the spacing between annuli.

It is believed that the most important consideration to bear in mind is that substantially improved practical results have been obtained using the structures disclosed herein, and that this fact is independent of the theory put forward concerning the mechanism involved in achieving such improvements.

It is to be understood that the invention is not limited to the features and embodiments hereinabove specifically set forth, but may be carried out in other ways without departure from the scope of the claims.

We claim:

1. A method of enhancing the heating of a surface of an article to be heated by microwave energy, comprising the step of directing said energy through a plurality of microwave-transparent apertures defined by annuli of microwave-reflective, substantially non-absorptive material and into the surface layer and thence into a main portion of the article wherein said microwave energy enters into said surface layer in the form of cut-off propagation to directly heat said surface layer without first converting such microwave energy into heat.

2. A method according to claim 1, wherein the surface layer has a lower dielectric constant than the main portion and said microwave energy is not in the form of cut-off propagation in the main portion, whereby to cause absorption of energy in the surface layer per unit distance into the article to be greater than absorption of energy per unit distance into the main portion and hence raise the surface layer to a temperature higher than that of the main portion.

3. A method according to claim 1 wherein each of said apertures has a width dimension from 5 to 25 mm.

4. A method according to claim 1, further comprising the step of generating higher order modes of microwave energy in the article to improve the uniformity of heating of the article in lateral directions transverse to a direction of propagation of the energy through the surface layer.

5. A mode-filtering device for enhancing the heating of a surface of an article to be heated by microwave energy and having a surface layer having a dielectric constant, comprising a sheet of microwave-transparent material including a plurality of microwave-transparent apertures defined by annuli of microwave-reflective, substantially non-absorptive material and for transmission of microwave energy at a frequency into the article to be heated by the microwave energy, wherein said sheet is located adjacent to the surface layer and said apertures have dimensions so that microwave energy enters through the apertures in the form of cut-off propagation into said surface layer to directly heat said surface layer without first converting such microwave energy into heat.

6. A device according to claim 5, the apertures have dimensions so that the microwave energy in the form of cut-off propagation propagated through the apertures is not absorbed in a main portion of the article located beneath the surface layer and having a higher dielectric constant than the surface layer.

7. A device according to claim 5, wherein said annuli are arranged in an array.

8. A device according to claim 7, wherein microwave-transparent material between said annuli traces out tortuous paths.

9. A device according to claim 7, wherein the annuli in said array are interconnected with each other by microwave-reflective, substantially non-absorptive material.

10. A device according to claim 5, wherein said annuli each has a shape and said shape is selected from the group consisting of rectangular, substantially square, substantially circular, substantially triangular, substantially hexagonal and combinations of at least two of such shapes.

11. A device according to claim 5, for use with a food article to be heated by microwave energy at a frequency of 2.45 GHz, wherein said apertures each have a transverse dimension in the range of 5 to 25 mm.

12. A device according to claim 5, wherein said annuli have an outer width of 10 mm to 16 mm.

13. A device according to claim 5, for use with an article the surface layer of which has a relatively low dielectric constant, wherein said annuli have an outer width of 20 mm to 25 mm.

14. A device according to claim 7, wherein said array provides a spacing between annuli of from 3 mm to 6 mm.

15. A device according to claim 5, further including an electrically conductive plate located on said sheet of microwave-transparent material, said plate defining at least one said aperture having a closed outer periphery, and at least one electrically conductive island disposed substantially in register with said aperture to define a microwave energy transmissive gap between the outer periphery of the island and the outer periphery of the aperture for generating in the article to be heated at least one microwave energy mode of a higher order than a fundamental mode in said article.

16. A device according to claim 15, wherein said gap is continuously open.

17. A device according to claim 15, wherein said gap is bridged at spaced intervals by electrically conductive material spanning the gap between said plate and said island.

18. A device according to claim 15, wherein said island has an aperture.

19. A device according to claim 15, wherein said plate and said island are disposed in coplanar relation to each other.

20. A device according to claim 15, wherein said plate and said island are respectively disposed in parallel planes spaced apart in a direction transverse to said planes.

21. A device according to claim 20, wherein said island is smaller in area than said aperture.

22. A device according to claim 20, wherein said island is at least equal in area to said aperture.

23. A device according to claim 15, wherein said plate defines a plurality of said apertures distributed over its area in spaced relation to each other, with a plurality of said islands disposed in register with respective apertures to provide an array of annular gaps distributed over the area of said plate.

24. A device according to claim 15, wherein the device forms a first wall portion of a container for said article.

25. A device according to claim 24, further comprising a second said device forming a further wall portion of the container opposed to the first wall portion.

26. A device according to claim 24, wherein said container comprises an upwardly opening tray for holding said article and a lid for covering the upward opening of the tray, said device being disposed on said lid with the conductive plate of the device extending over substantially the entire area of said lid.

27. A device according to claim 5, wherein said plurality of apertures are positioned on said sheet of microwave-transparent material and have an electromagnetic property different from that of the sheet.

28. A device according to claim 27, wherein said electromagnetic property is selected from conductivity, lossiness, dielectric constant, spatial thickness, a stepwise discontinuity and a magnetic property.

29. A device according to claim 5, wherein at least one of said annuli has at least one interruption therein.

30. A combination comprising:

an article to be heated by microwave energy, said article having a surface layer and a dielectric constant, a container in which said article is mounted, and a mode-filtering device incorporated in at least one wall of the container for enhancing the microwave energy heating of the article, said at least one wall being at least one of a bottom and a lid of said container, said device comprising a sheet of microwave-transparent material including a plurality of microwave-transparent apertures defined by annuli of microwave-reflective, substantially non-absorptive material and for transmission of microwave energy at a frequency into said article, wherein said sheet is located adjacent to the surface layer and said apertures have dimensions so that microwave energy enters through the apertures in the form of cut-off propagation into said surface layer to directly heat said surface layer without first converting such microwave energy into heat.

* * * * *